US005948582A

United States Patent [19]

Nakamura et al.

[11] Patent Number: 5,948,582

[45] Date of Patent: Sep. 7, 1999

[54] TONER FOR DEVELOPING ELECTROSTATIC IMAGE, IMAGE FORMING METHOD AND DEVELOPING APPARATUS UNIT

[75] Inventors: Tatsuya Nakamura, Tokyo; Shinya Yachi, Numazu; Michihisa Magome, Shizuoka-ken, all of Japan

[73] Assignee: Canon Kabushiki Kaisha, Tokyo, Japan

[21] Appl. No.: 09/050,464

[22] Filed: Mar. 31, 1998

[30] Foreign Application Priority Data

Apr. 2, 1997 [JP] Japan ..... 9-083467

[51] Int. Cl.[6] ..... G03G 9/08

[52] U.S. Cl. ..... 430/110; 430/111; 399/252

[58] Field of Search ..... 430/110, 106, 430/111, 137; 399/252

[56] References Cited

U.S. PATENT DOCUMENTS

| | | | |
|---|---|---|---|
| 5,219,697 | 6/1993 | Mori et al. | 430/110 |
| 5,354,640 | 10/1994 | Kanbayashi et al. | 430/110 |
| 5,415,967 | 5/1995 | Sakashita et al. | 430/137 |
| 5,487,841 | 1/1996 | Young et al. | 252/62.59 |
| 5,712,072 | 1/1998 | Inaba et al. | 430/110 |
| 5,753,396 | 5/1998 | Nakamura et al. | 430/101 |
| 5,773,185 | 6/1998 | Yachi et al. | 430/137 |
| 5,851,713 | 12/1998 | Hayashi et al. | 430/111 |

FOREIGN PATENT DOCUMENTS

| | | |
|---|---|---|
| 0658816 | 6/1995 | European Pat. Off. . |
| 0729075 | 8/1996 | European Pat. Off. . |
| 36-10231 | 7/1961 | Japan . |
| 43-10799 | 5/1968 | Japan . |
| 51-14895 | 5/1976 | Japan . |
| 8-136439 | 5/1996 | Japan . |

*Primary Examiner*—John Goodrow
*Attorney, Agent, or Firm*—Fitzpatrick, Cella, Harper & Scinto

[57] ABSTRACT

A toner for developing an electrostatic image is constituted by at least toner particles and an additive. The toner particles have a shape factor SF-1 of 100–160, a phase factor SF-2 of 100–140 and a weight-average particle size of 4–10 $\mu$m as measured by a Coulter counter. The toner contains particles having circle-equivalent diameters in a range of 0.6–2.0 $\mu$m and satisfying the following conditions (i)–(iii): (i) a first value $C_1$ of 3–50% by number as measured by a flow particle image analyzer after application of a ultrasonic wave of 20 kHz for 5 min., (ii) a second value $C_2$ of 2–40% by number as measured by the flow particle image analyzer after application of a ultrasonic wave of 20 kHz for 1 min., and (iii) a value C of 105–150 obtained according to the following equation: $C=(C_1/C_2)\times 100$ The toner is effective in improving image-forming characteristics in a continuous image formation on a large number of sheets.

90 Claims, 9 Drawing Sheets

TONER FOR DEVELOPING ELECTROSTATIC IMAGE, IMAGE FORMING METHOD AND DEVELOPING APPARATUS UNIT

FIELD OF THE INVENTION AND RELATED ART

The present invention relates to a toner for developing electrostatic images and an image forming method and a developing apparatus unit using the toner.

There have been known a large number of processes as an electrophotographic process. In these processes, in general, an electrostatic image is formed on a photosensitive member by various means employing a photoconductive material, then the electrostatic image is developed with a toner, and the resultant toner image, after being transferred onto a transfer-receiving material such as paper, as desired, fixed by heating and/or pressing to obtain a copy or print having thereon a fixed toner image.

Further, there have been also proposed various methods for developing an electrostatic image with a toner or for fixing a toner image.

The toner used for such purposes has generally been produced by melt-kneading a colorant (dye or pigment) and an optional additive within thermoplastic resin(s) to uniformly disperse the ingredients for the toner, finely pulverizing the dispersed product by a fine pulverizer, and classifying the pulverized product by a classifier to obtain a toner having a desired particle size distribution.

According to the production process (pulverization process), it is possible to provide a considerably excellent toner but is accompanied with a constraint on a selection range for toner materials or ingredients. For instance, a colorant-dispersed resin composition for producing toner particles used in the production process is required to be considerably fragile and the resultant dispersed product is also required to be finely pulverized by an economically and practically acceptable pulverizing device. In order to meet such requirements, however, when the colorant-dispersed resin composition is made fragile, a particle size range (distribution) of particles obtained by the fine pulverization is liable to become broad, particularly is liable to include a fine particle fraction in a large amount. In addition, the toner particles obtained from such a high fragile colorant-dispersed resin composition are liable to be further pulverized when used in a copying machine or printer. Further, in the pulverization process, it is difficult to uniformly dispersing the solid fine particles (such a colorant particles) within the resin component, thus leading to an increase in fog and lowerings in image density, color-mixing properties and transparency, depending upon a degree of the dispersions. Further, the resultant toner particles can cause a fluctuation in developing characteristics due to exposure of the colorant at the broken surface in some cases.

In order to remedy the above-mentioned problems of the toner particles obtained by the pulverization (production) process, there have been proposed production processes of toner particles according to a suspension polymerization process as described in Japanese Patent Publications (JP-B) Nos. 36-10231, 43-10799 and 51-14895.

In the production process by the suspension polymerization process, a monomer composition is prepared by uniformly dissolving or dispersing a polymerizable monomer, a colorant, a polymerization initiator, and optional components, such as a crosslinking agent, a charge control agent and other additives, as desired, and then the resultant monomer composition is dispersed into an aqueous phase containing a dispersion stabilizer by means of an appropriate stirring device to form particles of the monomer composition, followed by polymerization of the polymerizable monomer in the monomer composition to obtain toner particles having a desired particle size (distribution).

According to the production process (using the suspension polymerization), the resultant toner particles are not required to be fragile since the production process is not accompanied with the pulverizing step, thus readily including a soft material component within each toner particles. Further, the exposure of the colorant at the toner particle surface is not readily caused and the resultant toner particles have the advantage of having a uniform triboelectric chargeability.

Such toner particles produced through the suspension polymerization process, however, are in such a state that fine resin particles formed at the time of the polymerization and/or fine particles of an emulsified resin are attached to the respective toner particle surfaces. As a result, it is difficult to remove the fine resin particles from the toner particles by simply using a wind or pneumatic classifier.

The resultant toner or developer comprising the toner particles to which a large amount of the fine resin particles are attached is liable to be deteriorated when used for continuous image formation on a large number of sheets. For this reason, there has been desired to provide a toner improved in performances in continuous image formation on a large number of sheets.

SUMMARY OF THE INVENTION

A generic object of the present invention is to provide a toner for developing electrostatic images having solved the above-mentioned problems.

A specific object of the present invention is to provide a toner for developing electrostatic images excellent in performances in continuous image formation on a large number of sheets.

Another object of the present invention is to provide a toner for developing electrostatic images having a sable triboelectric chargeability in the continuous image formation.

Another object of the present invention is to provide a toner for developing electrostatic images by which a developing sleeve and/or a toner application member is not readily soiled.

Another object of the present invention is to provide a toner for developing electrostatic images excellent in transferability.

A further object of the present invention is to provide an image forming method using the above-mentioned toner.

A still further object of the present invention is to provide a developing apparatus unit including the above-mentioned toner.

According to the present invention, there is provided a toner for developing an electrostatic image, comprising: toner particles and an additive, wherein the toner particles have a shape factor SF-1 of 100–160, a phase factor SF-2 of 100–140 and a weight-average particle size of 4–10 $\mu$m as measured by a Coulter counter, and the toner contains particles having circle-equivalent diameters in a range of 0.6–2.0 $\mu$m and satisfying the following conditions (i)–(iii):

(i) a first value $C_1$ of 3–50% by number as measured by a flow particle image analyzer after application of a ultrasonic wave of 20 kHz for 5 min., (ii) a second value $C_2$ of 2–40% by number as measured by the flow particle image analyzer after application of a ultrasonic wave of 20 kHz for 1 min., and (iii) a value C of 105–150 obtained according to the following equation:

$$C=(C_1/C_2)\times 100.$$

According to the present invention, there is also provided an image forming method, comprising the steps of:

charging an electrostatic image-bearing member, exposing the charged electrostatic image-bearing member to light to form an electrostatic image, developing the electrostatic image by means of a developing apparatus unit including at least a toner-carrying member, toner application means for applying a toner onto a surface of the toner-carrying member and a toner vessel holding the toner to form a toner image on the electrostatic image-bearing member, transferring the toner image onto a transfer-receiving material via or not via an intermediate transfer member, and fixing the toner image on the transfer-receiving material by Hot-pressure fixing means, wherein the toner comprises toner particles and an additive, the toner particles have a shape factor SF-1 of 100–160, a phase factor SF-2 of 100–140 and a weight-average particle size of 4–10 μm as measured by a Coulter counter, and the toner contains particles having circle-equivalent diameters in a range of 0.6–2.0 μm and satisfying the following conditions (i)–(iii):

(i) a first value $C_1$ of 3–50% by number as measured by a flow particle image analyzer after application of a ultrasonic wave of 20 kHz for 5 min., (ii) a second value $C_2$ of 2–40% by number as measured by the flow particle image analyzer after application of a ultrasonic wave of 20 kHz for 1 min., and (iii) a value C of 105–150 obtained according to the following equation:

$$C=(C_1/C_2)\times 100.$$

According to the present invention, there is further provided a developing apparatus unit detachably mountable to a main body of an image forming apparatus, comprising:

at least a toner-carrying member, toner application means for applying a toner onto a surface of the toner-carrying member, and a toner vessel holding the toner, wherein the toner comprises toner particles and an additive, the toner particles have a shape factor SF-1 of 100–160, a phase factor SF-2 of 100–140 and a weight-average particle size of 4–10 μm as measured by a Coulter counter, and the toner contains particles having circle-equivalent diameters in a range of 0.6–2.0 μm and satisfying the following conditions (i)–(iii):

(i) a first value $C_1$ of 3–50% by number as measured by a flow particle image analyzer after application of a ultrasonic wave of 20 kHz for 5 min., (ii) a second value $C_2$ of 2–40% by number as measured by the flow particle image analyzer after application of a ultrasonic wave of 20 kHz for 1 min., and (iii) a value C of 105–150 obtained according to the following equation:

$$C=(C_1/C_2)\times 100.$$

These and other objects, features and advantages of the present invention will become more apparent upon a consideration of the following description of the preferred embodiments of the present invention taken in conjunction with the accompanying drawings.

DETAILED DESCRIPTION OF THE INVENTION

Figure 1:
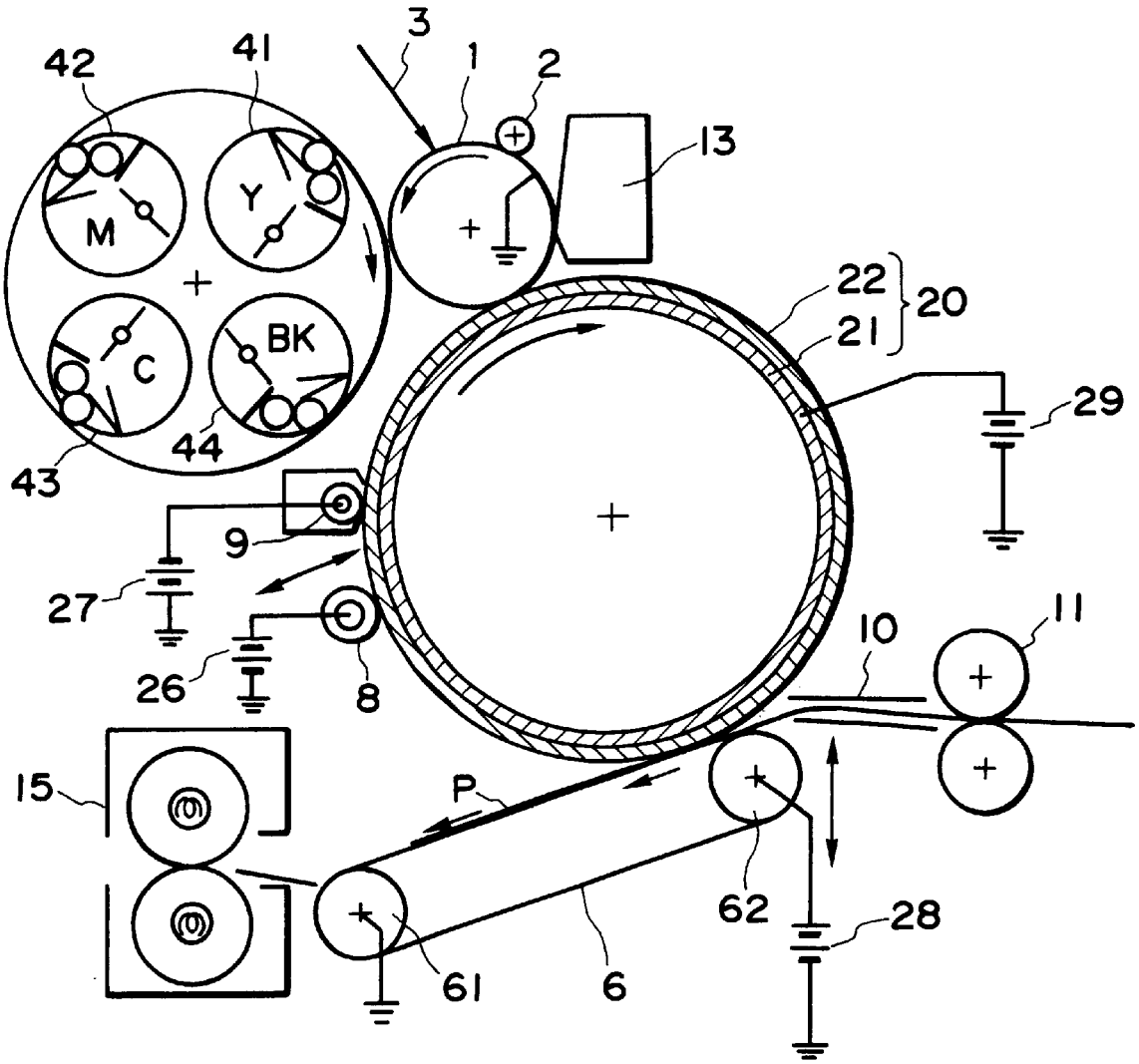
FIG. 1 is a schematic sectional view of an embodiment of an image forming apparatus, including a roller-shaped intermediate transfer member, suitable for the image forming method according to the present invention.

In the present invention, the toner comprising toner particles and an additive (external additive) is characterized by containing particles which have circle-equivalent diameters in a range of 0.6–2.0 μm and satisfy the following conditions (i), (ii) and (iii):

(i) a first value $C_1$ of 3–50% by number as measured by a flow particle image analyzer (herein, referred to as "FPIA measurement" specifically described below) after application of a ultrasonic wave of 20 kHz for 5 min., (ii) a second value $C_2$ of 2–40% by number as measured by the flow particle image analyzer after application of a ultrasonic wave of 20 kHz for 1 min., and (iii) a value C of 105–150 obtained according to the following equation:

$$C=(C_1/C_2)\times 100.$$

More specifically, with respect to the condition (ii), for measurement, a sample toner (5 mg) is dispersed for 1 min. in a solution of a nonionic surfactant (0.1 mg) in water (10 ml) by an ultrasonic disperser providing an ultrasonic wave of 20 kHz at an intensity of 50 W/10 $cm^3$ and then is subjected to measurement of a number-basis distribution of circle-equivalent diameters of 0.6–159.21 μm according to the FPIA measurement to obtain a first value $C_1$ (% by number) for particles having circle-equivalent diameters of 0.6–2.0 μm.

After the ultrasonic dispersion for 1 min., the (eternal) additive externally added to the toner particles and fine particles weakly attached to the surfaces of the toner particles are detached from the toner particle surfaces to form free fine particles to be counted as a second measured value $C_2$.

Thereafter, when the ultrasonic dispersion is further continued, fine particles still remaining on (attached to) the toner particle surfaces after the ultrasonic dispersion for 1 min. are detached therefrom to form additional free fine particles.

As a result, a first measured value $C_1$ after the ultrasonic dispersion for 5 min. in total (1 min.+4 min.) is cumulatively counted so that an amount (% by number) of the free fine particles newly detached from the toner particle surfaces from after the 1 min. of ultrasonic dispersion until after the 5 min. (in total) of ultrasonic dispersion is added to that (the second value ($C_1$) obtained after the 1 min. of ultrasonic dispersion.

The value (ratio) C ($=(C_1/C_2)\times100$) represents an increasing rate (ratio) of the first value $C_1$ to the second value $C_2$ in the FPIA measurement.

When the value C is in a range of 105–150, the toner is stably applied onto the surface of a toner-carrying member for a long period of time, thus stabilizing a triboelectric charge of the toner with the time.

Below 105, the stability of toner application onto the toner-carrying member surface is liable to be lowered, thus strengthening the tendency to provide an excessively thick toner layer formed on the toner-carrying member.

Above 150, an amount of fine particles detached from the surfaces of the toner particles in a continuous image formation on a large number of sheets is excessively increased, thus being liable to cause a lowering in triboelectric chargeability, an irregularity (unevenness) in toner image and a lowering in transferability.

The value C may preferably be in a range of 110–145, more preferably 115–140.

In the present invention, the toner has a first value $C_1$ of 3–50% by number, preferably 3–45% by number, more preferably 3–40% by number.

If the first value $C_1$ is in excess of 50% by number, fine particles having circle-equivalent diameters of 0.6–2.0 μm are liable to soil a developing sleeve and/or a charging member, whereby the triboelectric chargeability of the toner is liable to be lowered and the toner is not readily uniformly applied onto the developing sleeve, thus being liable to cause a streak unevenness in a resultant toner image.

On the other hand, if the first value $C_1$ is below 3% by number, the triboelectric charge of the toner in a low-temperature and low-humidity environment is increased (so-called charge-up phenomenon), whereby the developing sleeve is not readily coated with the toner uniformly, thus being liable to cause a wavy(-shaped) unevenness in a halftone toner image.

In the present invention, the toner also has a second value $C_2$ of 2–40% by number, preferably 3–35% by number, more preferably 8–25% by number.

In a preferred embodiment, the toner according to the present invention may desirably have a first value $C_1$ of 5–40% by number, particularly 10–35% by number; a second value $C_2$ of 3–35% by number, particularly 8–25% by number; and a value C of 110–145, particularly 115–140, in view of stabilizations of the triboelectric charge and coating state of the toner layer formed on the toner-carrying member in a continuous image formation on a large number of sheets.

Hereinbelow, the FPIA measurement for determining the above-described values $C_1$, $C_2$ and C will be specifically explained.

FPIA measurement

Flow Particle Image Analyzer ("FPIA-1000", available from Toa Iyou Denshi K.K.) is used for the measurement.

Into 10 ml of water from which fine dirt has been removed by passing through a filter so as to reduce the number of contaminant particles (having particle sizes in the measurement range (i.e., circle-equivalent diameters of 0.60–159.21 μm)) to at most 20 particles, 0.1 mg of a nonionic surfactant (e.g., "Contaminone N", mfd. by Wako Junyaku K.K.) is added as a dispersant, and 5 mg of a sample is added, followed by 1 min. of dispersion (for $C_2$ measurement) and 4 min. (5 min. in total) of dispersion (for $C_1$ measurement) by means of an ultrasonic disperser (e.g., "UH-50", mfd. by SMT Co.) providing an ultrasonic wave of 20 kHz at an intensity of 50 W/10 $cm^3$, to form a sample dispersion liquid having a concentration of 4000–8000 particles/$10^{-3}$ $cm^3$ (based on particles in the measurement range). The sample dispersion liquid is subjected to measurement of particle size distribution in a circle-equivalent diameter range of 0.60–159.21 μm (upper limit, not inclusive).

The outline of the measurement (based on a technical brochure and an attached operation manual on "FPIA-1000" published from Toa Iyou Denshi K.K. (Jun. 1995), and JP-A 8-136439) is as follows.

A sample dispersion liquid is caused to flow through a thin transparent flow cell (thickness=ca. 200 μm) having a divergent flow path. A strobe and a CCD camera are disposed at mutually opposite positions with respect to the flow cell so as to form an optical path passing across the thickness of the flow cell. During the flow of the sample dispersion liquid, the strobe is flashed at intervals of 1/30 second each to capture images of particles passing through the flow cell, so that each particle provides a two dimensional image having a certain area parallel to the flow cell. From the two-dimensional image area of each particle, a diameter of a circle having an identical area is determined as a circle-equivalent diameter. During ca. 1 min., circle-equivalent diameters of more than 1200 particles can be determined, from which a number basis circle-equivalent diameter distribution, and a proportion (% by number) of particles having a prescribed circle-equivalent diameter range can be determined. (As a specific example, in the case of a toner dispersion liquid containing ca. 6000 particles/$10^{-3}$ $cm^3$, the diameters of ca. 1800 particles can be determined in ca. 1 min.) The results (frequency % and cumulative %) may be given for 226 channels in the range of 0.60 μm–400.00 μm (80 channels (divisions) for one octave) as shown in the following Table 1 (for each channel, the lower limit size value is included and the upper limit size value is excluded), whereas particles having circle-equivalent diameters in a range of 0.60 μm–159.21 μm (upper limit, not inclusive) are subjected to an actual measurement.

TABLE 1

| Circle-equivalent diameter (C. E. D.) ranges for respective channels (Ch) | |
|---|---|
| Ch | C. E. D. range (μm) |
| 1 | 0.60–0.61 |
| 2 | 0.61–0.63 |
| 3 | 0.63–0.65 |
| 4 | 0.65–0.67 |
| 5 | 0.67–0.69 |
| 6 | 0.69–0.71 |
| 7 | 0.71–0.73 |
| 8 | 0.73–0.75 |
| 9 | 0.75–0.77 |
| 10 | 0.77–0.80 |
| 11 | 0.80–0.82 |
| 12 | 0.82–0.84 |
| 13 | 0.84–0.87 |
| 14 | 0.87–0.89 |
| 15 | 0.89–0.92 |
| 16 | 0.92–0.95 |
| 17 | 0.95–0.97 |
| 18 | 0.97–1.00 |
| 19 | 1.00–1.03 |
| 20 | 1.03–1.06 |
| 21 | 1.06–1.09 |
| 22 | 1.09–1.12 |
| 23 | 1.12–1.16 |
| 24 | 1.16–1.19 |
| 25 | 1.19–1.23 |
| 26 | 1.23–1.26 |
| 27 | 1.26–1.30 |
| 28 | 1.30–1.34 |
| 29 | 1.34–1.38 |
| 30 | 1.38–1.42 |
| 31 | 1.42–1.46 |
| 32 | 1.46–1.50 |
| 33 | 1.50–1.55 |
| 34 | 1.55–1.59 |
| 35 | 1.59–1.64 |
| 36 | 1.64–1.69 |
| 37 | 1.69–1.73 |
| 38 | 1.73–1.79 |
| 39 | 1.79–1.84 |
| 40 | 1.84–1.89 |
| 41 | 1.89–1.95 |
| 42 | 1.95–2.00 |
| 43 | 2.00–2.06 |
| 44 | 2.06–2.12 |
| 45 | 2.12–2.18 |
| 46 | 2.18–2.25 |
| 47 | 2.25–2.31 |
| 48 | 2.31–2.38 |
| 49 | 2.38–2.45 |
| 50 | 2.45–2.52 |
| 51 | 2.52–2.60 |
| 52 | 2.60–2.67 |
| 53 | 2.67–2.75 |
| 54 | 2.75–2.83 |
| 55 | 2.83–2.91 |
| 56 | 2.91–3.00 |
| 57 | 3.00–3.09 |
| 58 | 3.09–3.18 |
| 59 | 3.18–3.27 |
| 60 | 3.27–3.37 |
| 61 | 3.37–3.46 |
| 62 | 3.46–3.57 |
| 63 | 3.57–3.67 |
| 64 | 3.67–3.78 |
| 65 | 3.78–3.89 |
| 66 | 3.89–4.00 |
| 67 | 4.00–4.12 |
| 68 | 4.12–4.24 |
| 69 | 4.24–4.36 |
| 70 | 4.36–4.49 |
| 71 | 4.49–4.62 |
| 72 | 4.62–4.76 |
| 73 | 4.76–4.90 |
| 74 | 4.90–5.04 |

TABLE 1-continued

| Circle-equivalent diameter (C. E. D.) ranges for respective channels (Ch) | |
|---|---|
| Ch | C. E. D. range (μm) |
| 75 | 5.04–5.19 |
| 76 | 5.19–5.34 |
| 77 | 5.34–5.49 |
| 78 | 5.49–5.65 |
| 79 | 5.65–5.82 |
| 80 | 5.82–5.99 |
| 81 | 5.99–6.16 |
| 82 | 6.16–6.34 |
| 83 | 6.34–6.53 |
| 84 | 6.53–6.72 |
| 85 | 6.72–6.92 |
| 86 | 6.92–7.12 |
| 87 | 7.12–7.33 |
| 88 | 7.33–7.54 |
| 89 | 7.54–7.76 |
| 90 | 7.76–7.99 |
| 91 | 7.99–8.22 |
| 92 | 8.22–8.46 |
| 93 | 8.46–8.71 |
| 94 | 8.71–8.96 |
| 95 | 8.96–9.22 |
| 96 | 9.22–9.49 |
| 97 | 9.49–9.77 |
| 98 | 9.77–10.05 |
| 99 | 10.05–10.35 |
| 100 | 10.35–10.65 |
| 101 | 10.65–10.96 |
| 102 | 10.96–11.28 |
| 103 | 11.28–11.61 |
| 104 | ll.61–11.95 |
| 105 | 11.95–12.30 |
| 106 | 12.30–12.66 |
| 107 | 12.66–13.03 |
| 108 | 13.03–13.41 |
| 109 | 13.41–13.80 |
| 110 | 13.80–14.20 |
| 111 | 14.20–14.62 |
| 112 | 14.62–15.04 |
| 113 | 15.04–15.48 |
| 114 | 15.48–15.93 |
| 115 | 15.93–16.40 |
| 116 | 16.40–16.88 |
| 117 | 16.88–17.37 |
| 118 | 17.37–17.88 |
| 119 | 17.88–18.40 |
| 120 | 18.40–18.94 |
| 121 | 18.94–19.49 |
| 122 | 19.49–20.06 |
| 123 | 20.06–20.65 |
| 124 | 20.65–21.25 |
| 125 | 21.25–21.87 |
| 126 | 21.87–22.51 |
| 127 | 22.51–23.16 |
| 128 | 23.16–23.84 |
| 129 | 23.84–24.54 |
| 130 | 24.54–25.25 |
| 131 | 25.25–25.99 |
| 132 | 25.99–26.75 |
| 133 | 26.75–27.53 |
| 134 | 27.53–28.33 |
| 135 | 28.33–29.16 |
| 136 | 29.16–30.01 |
| 137 | 30.01–30.89 |
| 138 | 30.89–31.79 |
| 139 | 31.79–32.72 |
| 140 | 32.72–33.67 |
| 141 | 33.67–34.65 |
| 142 | 34.65–35.67 |
| 143 | 35.67–36.71 |
| 144 | 36.71–37.78 |
| 145 | 37.78–38.88 |
| 146 | 38.88–40.02 |
| 147 | 40.02–41.18 |
| 148 | 41.18–42.39 |

TABLE 1-continued

| Circle-equivalent diameter (C. E. D.) ranges for respective channels (Ch) | |
|---|---|
| Ch | C. E. D. range (μm) |
| 149 | 42.39–43.62 |
| 150 | 43.62–44.90 |
| 151 | 44.90–46.21 |
| 152 | 46.21–47.56 |
| 153 | 47.56–48.94 |
| 154 | 48.94–50.37 |
| 155 | 50.37–51.84 |
| 156 | 51.84–53.36 |
| 157 | 53.36–54.91 |
| 158 | 54.91–56.52 |
| 159 | 56.52–58.17 |
| 160 | 58.17–59.86 |
| 161 | 59.86–61.61 |
| 162 | 61.61–63.41 |
| 163 | 63.41–65.26 |
| 164 | 65.26–67.16 |
| 165 | 67.16–69.12 |
| 166 | 69.12–71.14 |
| 167 | 71.14–73.22 |
| 168 | 73.22–75.36 |
| 169 | 75.36–77.56 |
| 170 | 77.56–79.82 |
| 171 | 79.82–82.15 |
| 172 | 82.15–84.55 |
| 173 | 84.55–87.01 |
| 174 | 87.01–89.55 |
| 175 | 89.55–92.17 |
| 176 | 92.17–94.86 |
| 177 | 94.86–97.63 |
| 178 | 97.63–100.48 |
| 179 | 100.48–103.41 |
| 180 | 103.41–106.43 |
| 181 | 106.43–109.53 |
| 182 | 109.53–112.73 |
| 183 | 112.73–116.02 |
| 184 | 116.02–119.41 |
| 185 | 119.41–122.89 |
| 186 | 122.89–126.48 |
| 187 | 126.48–130.17 |
| 188 | 130.17–133.97 |
| 189 | 133.97–137.88 |
| 190 | 137.88–141.90 |
| 191 | 141.90–146.05 |
| 192 | 146.05–150.31 |
| 193 | 150.31–154.70 |
| 194 | 154.70–159.21 |
| 195 | 159.21–163.86 |
| 196 | 163.86–168.64 |
| 197 | 168.64–173.56 |
| 198 | 173.56–178.63 |
| 199 | 178.63–183.84 |
| 200 | 183.84–189.21 |
| 201 | 189.21–194.73 |
| 202 | 194.73–200.41 |
| 203 | 200.41–206.26 |
| 204 | 206.26–212.28 |
| 205 | 212.28–218.48 |
| 206 | 218.48–224.86 |
| 207 | 224.86–231.42 |
| 208 | 231.42–238.17 |
| 209 | 238.17–245.12 |
| 210 | 245.12–252.28 |
| 211 | 252.28–259.64 |
| 212 | 259.64–267.22 |
| 213 | 267.22–275.02 |
| 214 | 275.02–283.05 |
| 215 | 283.05–291.31 |
| 216 | 291.31–299.81 |
| 217 | 299.81–308.56 |
| 218 | 308.56–317.56 |
| 219 | 317.56–326.83 |
| 220 | 326.83–336.37 |
| 221 | 336.37–346.19 |
| 222 | 346.19–356.29 |

TABLE 1-continued

| Circle-equivalent diameter (C. E. D.) ranges for respective channels (Ch) | |
|---|---|
| Ch | C. E. D. range (μm) |
| 223 | 356.29–366.69 |
| 224 | 366.69–377.40 |
| 225 | 377.40–388.41 |
| 226 | 388.41–400.00 |

Figure 4:
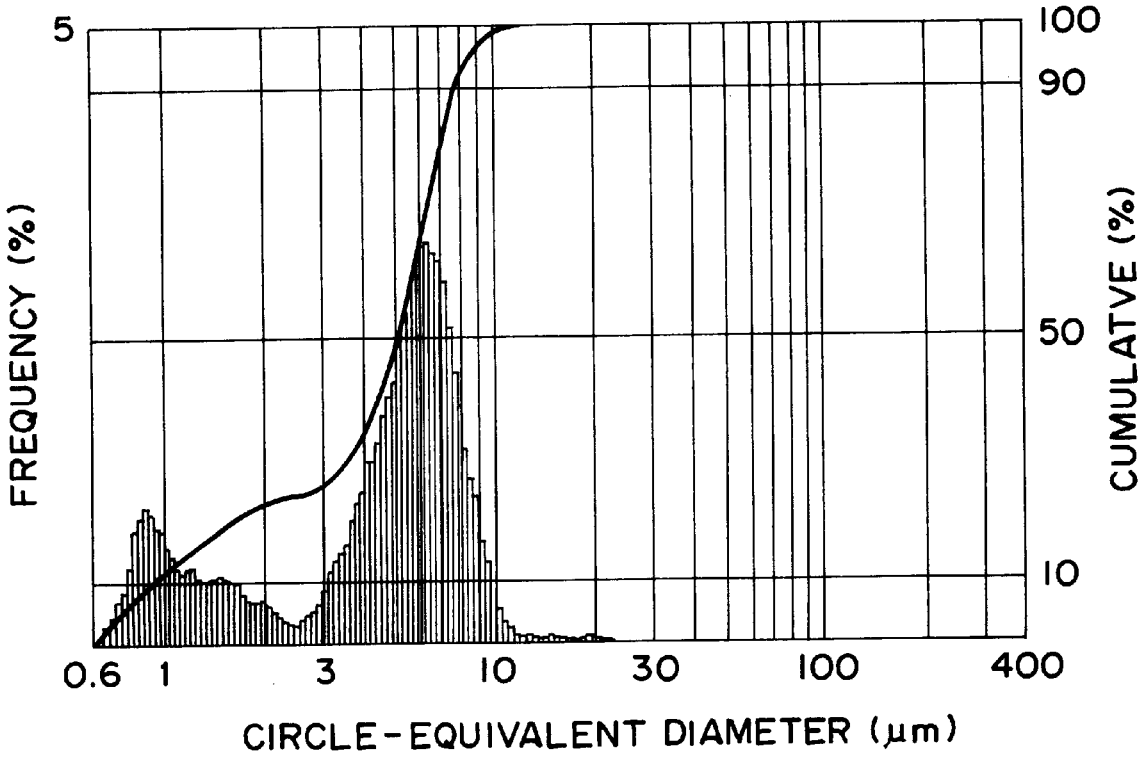
FIG. 4 is a graph showing an example of a number-basis distribution of circle-equivalent diameters of a toner as measured by a flow particle image analyzer.

An example of a number-basis circle-equivalent diameter distribution obtained for a toner according to the above-described FPIA measurement is given in FIG. 4.

In the present invention, the toner particles constituting the toner according to the present invention have a shape factor SF-1 of 100–160 and a shape factor SF-2 of 100–140.

If the SF-1 exceeds 160 or/and the SF-2 exceeds 140, the addition effect of the (external) additive is lowered and the transferability of the toner is also lowered, thus deteriorating image-forming performances of the toner in a continuous image formation on a large number of sheets.

These phenomena are particularly noticeable in the case of a toner for a non-magnetic monocomponent developing.

The shape factor SF-1 may preferably be 100–150, more preferably 100–130, and the shape factor SF-2 may preferably be 100–130, more preferably 100–125.

In the present invention, the shape factors SF-1 and SF-2 are determined based on values obtained in the following manner.

100 toner particle images observed through a field emission scanning electron microscope (FE-SEM) (e.g., "S-800", available from Hitachi Ltd.) at a magnification of 500 are sampled at random. The resultant image data of the toner particle images are inputted into an image analyzer (e.g., "Luzex III, available from Nireco K.K.) through an interface, whereby SF-1 and SF-2 are determined based on the following equations:

$$SF\text{-}1=[(\mathrm{MXLNG})^2/\mathrm{AREA}]\times(\pi/4)\times 100,$$

$$SF\text{-}2=[(\mathrm{PERI})^2/\mathrm{AREA}]\times(1/4\pi)\times 100,$$

wherein MXLNG denotes the maximum length (diameter) of a toner particle, AREA denotes the projection area of a toner particle, and PERI denotes a perimeter (i.e., a peripheral length of the outer surface) of a toner particle.

In the above measurement for the shape factors SF-1 and SF-2, the toner comprising toner particles externally blended with an additive generally provides an SF-1 and an SF-2 each substantially equal to those for the toner particles before the external blending with the additive.

The toner toner of the present invention comprises toner particles having a weight-average particle size ($D_4$) of 4–10 μm, preferably 4–8 μm.

Above 10 μm, the resultant resolution of the toner image is decreased. Below 4 μm, the resultant image density at a solid image portion is lowered.

On the other hand, when the toner particles have a $D_4$ in a range of 4–10 μm, a uniform toner layer can readily be liable to be formed on the developing sleeve even in the case of the non-magnetic monocomponent developing method.

The weight-average particle size ($D_4$) value of the toner particles and the toner according to the present invention is based on the following Coulter counter measurement.

Coulter counter (CC) measurement

Coulter counter "Model TA-II" (available from Coulter Electronics Inc.) or Coulter Multisizer II (available from Coulter Electronics Inc.) may, e.g., be used as a measuring apparatus. A 1%-NaCl aqueous solution is prepared as an electrolytic solution by using a reagent-grade sodium chloride (it is also possible to use ISOTON R-II (available from Coulter Scientific Japan K.K.)). For the measurement, 0.1 to 5 ml of a surfactant, preferably a solution of an alkylbenzenesulfonic acid salt, is added as a dispersant into 100 to 150 ml of the electrolytic solution, and 2–20 mg of sample toner particles (or a sample toner) are added thereto. The resultant dispersion of the sample in the electrolytic solution is subjected to a dispersion treatment for ca. 1–3 minutes by means of an ultrasonic disperser, and then subjected to measurement of particle size distribution in the range of 2.00–40.30 μm divided into 13 channels by using the above-mentioned apparatus with a 100 μm-aperture to obtain a volume-basis distribution and a number-basis distribution. From the volume-basis distribution, a weight-average particle size ($D_4$) is calculated by using a central value as a representative value for each channel.

The particle size range of 2.00–40.30 μm is divided into 13 channels of 2.00–2.52 μm; 2.52–3.17 μm; 3.17–4.00 μm; 4.00–5.04 μm; 5.04–6.35μm; 6.35–8.00 μm; 8.00–10.08 μm; 10.08–12.70 μm; 12.70–16.00 μm; 16.00–20.20 μm; 20.20–25.40 μm; 25.40–32.00 μm; and 32.00–40.30 μm. For each channel, the lower limit value is included, and the upper limit value is excluded.

In the above measurement for the weight average particle size ($D_4$), the toner comprising toner particles externally blended with an additive ordinarily provides a $D_4$ substantially equal to that for the toner particles not externally blended with the additive.

In the present invention, the toner particles may preferably contain a low-softening point substance (a substance showing a low-softening point) in order to improve a fixability. The low-softening point substance may preferably provide a DSC curve, as measured by a differential scanning calorimeter according to ASTM D3418-8, showing a principal heat absorption peak temperature of 40–90° C. If the temperature is below 40° C., the low-softening point substance is lowered in its self-cohesive force, thus resulting in a decreased anti-offset characteristic at high temperature. On the other hand, if the temperature is above 90° C., a fixation temperature is undesirably increased. In the case of directly producing toner particles by direct polymerization (appearing hereinbelow), steps of forming particles and polymerization are performed in an aqueous medium, so that the low-softening point substance is not softened at the time of the particle formation if the above-mentioned temperature is high (e.g., above 90° C.). As a result, it is difficult to provide a sharp particle size distribution of the resultant toner particles.

Preparation of a heat absorption (DSC) curve for the low-softening point substance may be performed by using, e.g., a commercially available differential scanning calorimeter ("DSC-7" (trade name), manufactured by Perkin-Elmer Corp.). In the apparatus, temperature correction at a sensor (detection) portion is effected by using melting points of indium and zinc and correction of heat quantity at the sensor portion is effected by using a heat of fusion of indium. A sample is placed on an aluminum pan and a blank pan is set for reference. The DSC measurement is performed by heating (temperature increase) at a rate of 10° C./min.

Examples of the low-softening point substance may include paraffin wax, polyolefin wax, Fischer-Tropsch wax, amide wax, higher fatty acid, ester wax, derivatives thereof, grafted compounds thereof and blocked compounds thereof.

The low-softening point substance may preferably be added into the toner particles in an amount of 3–30 wt. %. Below 3 wt. %, the fixability and the anti-offset characteristic are liable to be lowered. Above 30 wt. %, the toner particles are liable to cause coalescent or aggregation therebetween during the particle formation even in the polymerization production process, thus being liable to have a broad particle size distribution.

In order to include the low-softening point substance in the toner particles, a specific method therefor may be performed by setting a polarity in an aqueous medium of the low-softening point substance lower than that of a principal monomer component and adding a small amount of a resin or a monomer having a larger polarity to the above system to form toner particles having a core-shell structure comprising the low-softening point substance enclosed by (coated with) the outer resin. In this instance, control of a particle size distribution or a particle size of the toner particles may be performed by appropriately changing an inorganic salt having little water-soluble characteristic or a dispersant functioning as a protective colloid and the addition amount thereof or controlling stirring conditions of a particle-forming apparatus (such as a peripheral speed of a rotor, number of pass for the aqueous medium and a stirring blade shape) and a shape of a reaction vessel, or the solid content and the viscosity of the polymer composition in the aqueous medium. As a result, it is possible to obtain toner particles having a prescribed particle size (distribution).

In the present invention, cross-section observation of the toner particles through a transmission electron microscope (TEM) may be performed as follows.

Sample toner particles are dispersed in a cold-setting epoxy resin and are cured or hardened for 2 days at 40° C. The resultant hardened product is cut out in the form of a thin film by a microtome having diamond teeth. The resultant thin film of the sample toner particles is subjected to observation through the TEM. In the present invention, a dyeing method using triruthenium tetraoxide (optionally in combination with triosmium tetraoxide) may preferably be used in order to provide a contrast between the low-softening point substance and the outer resin by utilizing a difference in crystallinity therebetween.

In the present invention, examples of a polymerizable monomer for producing a binder resin may include: vinyl-type monomers, examples of which may include: styrene and its derivatives such as styrene, o-, m- or p-methylstyrene, and m- or p-ethylstyrene; (meth)acrylic acid esters such as methyl (meth)acrylate, ethyl (meth) acrylate, propyl (meth)acrylate, butyl (meth)acrylate, octyl (meth)acrylate, dodecyl (meth)acrylate, 2-ethylhexyl (meth) acrylate, stearyl (meth)acrylate, behenyl (meth)acrylate, dimethylaminoethyl (meth)acrylate, and diethylaminoethyl (meth)acrylate; butadiene; isoprene; cyclohexene; (meth) acrylonitrile, and acrylamide. These monomers may be used singly or in mixture of two or more species.

The above monomers may preferably have a theoretical glass transition point (Tg), described in "POLYMER HANDBOOK", second addition, III-pp. 139–192 (available from John Wiley & Sons Co.), of 40–75° C. singly or in mixture. If the theoretical glass transition point is below 40° C., the resultant toner particles are lowered in storage stability and durability (stability of toner performances in a continuous image formation on a large number of sheets). On the other hand, the theoretical glass transition point is in excess of 75° C., the fixation temperature of the toner is increased, whereby respective color toner particles have insufficient color-mixing characteristics in the case of full-color image formation in particular. As a result, the resultant toner has a poor color reproducibility and undesirably lower a transparency of an OHP image.

In the present invention, the molecular-weight (distribution) of the binder resin may be measured by gel permeation chromatography (GPC) as follows.

In the case of toner particles having a core-shell structure, the toner particles or the toner is subjected to extraction with toluene for 20 hours by means of Soxhlet extractor in advance, followed by distilling-off of the solvent (toluene) to obtain an extract. An organic solvent (e.g., chloroform) in which a low-softening point substance is dissolved and a binder resin is not dissolved is added to the extract and sufficiently washed therewith to obtain a residue product. The residue product is dissolved in tetrahydrofuran (THF) and subjected to filtration with a solvent-resistance membrane filter having a pore size of 0.3 $\mu$m to obtain a sample solution (THF solution). The sample solution is injected in a GPC apparatus ("GPC-150C", available from Waters Co.) using columns of A-801, 802, 803, 804, 805, 806 and 807 (manufactured by Showa Denko K.K.) connected to each other in combination. The identification of sample molecular weight and its molecular weight distribution are performed based on a calibration curve obtained by using monodisperse polystyrene standard samples. In the present invention, the binder resin may preferably have a weight-average molecular weight (Mw) of 5,000–1,000,000 and a ratio of the weight-average molecular weight (Mw) to a number-average molecular weight (Mn) (i.e., Mw/Mn) of 2–100.

In order to enclose the low-softening point substance in the outer resin (layer) for preparing the toner particles each having the core-shell structure, it is particularly preferred to add a polar resin other than the binder resin. Preferred examples of such a polar resin used in the present invention may include styrene-(meth)acrylate copolymer, maleic acid-based copolymer, saturated polyester resin, epoxy resin and polycarbonate resin. The polar resin may particularly preferably have no unsaturated group capable of reacting with the outer resin or a vinyl monomer constituting the outer resin. This is because if the polar resin has an unsaturated group, the unsaturated group causes crosslinking reaction with the vinyl monomer, thus resulting in a resin component having an excessively high molecular weight. As a result, such a polar resin is lowered in color-mixing characteristic with respect to three color toners for full-color image formation.

In the present invention, it is possible to further form an outermost resin layer on the surfaces of the toner particles.

An outermost resin for the outermost resin layer may preferably have a glass transition point higher than that of the above-mentioned outer resin in view of a further improvement in anti-blocking characteristic. Further, the outermost resin may preferably be crosslinked to the extent that the resultant fixability is not impaired.

In the outermost resin layer, the polar resin and a charge control agent may be incorporated in order to improve a chargeability.

The outermost layer may, e.g., be formed by the following methods 1), 2) and 3).

1) During a later stage or after the polymerization reaction, a monomer composition containing, e.g., a polar resin, a charge control agent and a crosslinking agent dissolved or dispersed therein is added in a reaction system, as desired, so as to be adsorbed by polymerizable particles, followed by addition of a polymerization initiator to effect polymerization of the monomer component.

2) Into the reaction system, polymerization particles obtained through emulsion or soap-free polymerization of a monomer composition containing, e.g., a polar resin, a charge control agent and a crosslinking agent, as desired, are added, whereby the polymerization particles are aggregated or attached to the surfaces of the (polymerization) toner particles optionally under heating for fixing, as desired.

3) Such polymerization particles (used in the method 2)) are dry-blended mechanically with the toner particles for fixing at the toner particle surfaces.

The colorant used in the present invention may include a black colorant, yellow colorant, a magenta colorant and a cyan colorant.

Examples of the black colorant may include: carbon black, a magnetic material, and a colorant showing black by color-mixing of yellow/magenta/cyan colorants shown below.

Examples of the yellow colorant may include: condensed azo compounds, isoindolinone compounds, anthraquinone compounds, azo metal complexes, methine compounds and arylamide compounds. Specific preferred examples thereof may include C.I. Pigment Yellow 12, 13, 14, 15, 17, 62, 74, 83, 93, 94, 95, 109, 110, 111, 128, 129, 147 and 168.

Examples of the magenta colorant may include: condensed azo compounds, diketopyrrolpyrrole compounds, anthraquinone compounds, quinacridone compounds, basis dye lake compounds, naphthol compounds, benzimidazole compounds, thioindigo compounds an perylene compounds. Specific preferred examples thereof may include: C.I. Pigment Red 2, 3, 5, 6, 7, 23, 48:2, 48:3, 48:4, 57:1, 81:1, 144, 146, 166, 169, 177, 184, 185, 202, 206, 220, 221 and 254.

Examples of the cyan colorant may include: copper phthalocyanine compounds and their derivatives, anthraquinone compounds and basis dye lake compounds. Specific preferred examples thereof may include: C.I. Pigment Blue 1, 7, 15, 15:1, 15:2, 15:3, 15:4, 60, 62, and 66.

These colorants may be used singly, in mixture of two or more species or in a state of solid solution. The above colorants may be appropriately selected in view of hue, color saturation, color value, weather resistance, OHP transparency, and a dispersibility in toner particles. The above colorants may preferably be used in a proportion of 1–20 wt. parts per 100 wt. parts of the resin. The black colorant comprising the magnetic material may preferably be used in a proportion of 40–150 wt. parts per 100 wt. parts of the resin.

The charge control agent used in the present invention may include known charge control agents. The charge control agent may preferably be one being colorless and having a higher charging speed and a property capable of stably retaining a prescribed charge amount. In the case of using the direct polymerization for producing the toner particles of the present invention, the charge control agent may particularly preferably be one free from polymerization-inhibiting properties and not or little containing a component soluble in an aqueous medium.

The charge control agent used in the present invention may be those of negative-type or positive-type. Specific examples of the negative charge control agent may include: metal-containing acid-based compounds comprising acids such as salicylic acid, naphtoic acid, and dicarboxylic acid; polymeric compounds having a side chain comprising sulfonic acid or carboxylic acid; boron compound; urea compounds; silicon compound; and calixarene. Specific examples of the positive charge control agent may include: quaternary ammonium salts; polymeric compounds having a side chain comprising quaternary ammonium salts; guanidine compounds; and imidazole compounds.

The charge control agent used in the present invention may preferably be used in a proportion of 0.5–10 wt. parts per 100 wt. parts of the resin.

However, the charge control agent is not an essential component for the toner particles used in the present invention. The charge control agent can be used as an optional additive in some cases. More specifically, in the case of using two-component developing method, it is possible to utilize triboelectric charge with a carrier. In the case of using a non-magnetic one-component blade coating developing method, it is aggressively utilize triboelectric charge with a blade member or a sleeve member.

Examples of the polymerization initiator usable in the direct polymerization may include: azo- or diazo-type polymerization initiators, such as 2,2'-azobis-(2,4-dimethylvaleronitrile), 2,2'-azobisisobutylonitrile, 1,1'-azobis(cyclohexane-2-carbonitrile), 2,2'-azobis-4-methoxy-2,4-dimethylvaleronitrile, azobisisobutyronitrile; and peroxide-type polymerization initiators such as benzoyl peroxide, methyl ethyl ketone peroxide, diisopropyl peroxycarbonate, cumene hydroperoxide, 2,4-dichlorobenzoyl peroxide, and lauroyl peroxide. The addition amount of the polymerization initiator varies depending on the molecular weight of the binder resin to be attained. The polymerization initiator may generally be used in the range of about 0.5–20 wt. parts based on 100 wt. parts of the polymerizable monomer used. The polymerization initiators somewhat vary depending on the polymerization process used and may be used singly or in mixture while making reference to 10-hour half-life period temperature.

In order to control a polymerization degree of the resultant binder resin, it is also possible to add a crosslinking agent, a chain transfer agent, a polymerization inhibitor, etc.

In production of the polymerization toner particles by the suspension polymerization using a dispersion stabilizer, it is preferred to use an inorganic or/and an organic dispersion stabilizer in an aqueous dispersion medium. Examples of the inorganic dispersion stabilizer may include: tricalcium phosphate, magnesium phosphate, aluminum phosphate, zinc phosphate, calcium carbonate, magnesium carbonate, calcium hydroxide, magnesium hydroxide, aluminum hydroxide, calcium metasilicate, calcium sulfate, barium sulfate, bentonite, silica, and alumina. Examples of the organic dispersion stabilizer may include: polyvinyl alcohol, gelatin, methyl cellulose, methyl hydroxypropyl cellulose, ethyl cellulose, carboxymethyl cellulose sodium salt and starch. These dispersion stabilizers may preferably be used in the aqueous dispersion medium in an amount of 0.2–20 wt. parts per 100 wt. parts of the polymerizable monomer composition (mixture).

In the case of using an inorganic dispersion stabilizer, a commercially available product can be used as it is, but it is also possible to form the stabilizer in situ in the dispersion medium under high-speed stirring so as to obtain fine particles thereof with a uniform particle size. In the case of tricalcium phosphate, for example, an aqueous sodium phosphate solution and an aqueous calcium chloride solution may be blended under an intensive stirring to obtain tricalcium phosphate particles suitable for the suspension polymerization.

In order to effect fine dispersion of the dispersion stabilizer, it is also effective to use 0.001–0.1 wt. % of a nonionic, anionic or cationic surfactant in combination. Examples of the surfactant may include: sodium dodecylbenzenesulfonate, sodium tetradecyl sulfate, sodium pentadecyl sulfate, sodium octyl sulfate, sodium oleate, sodium laurate, potassium stearate, and calcium oleate.

The toner particles used in the present invention may be produced by direct polymerization in the following manner. A polymerizable monomer, a low-softening point substance, a colorant, a polymerization initiator and another optional additive are uniformly dissolved or dispersed by a homogenizer or an ultrasonic dispersing device to form a polymerizable monomer composition, which is then dispersed and formed into particles in an aqueous dispersion medium containing a dispersion stabilizer by means of a stirrer, homomixer or homogenizer preferably under such a condition that droplets of the polymerizable monomer composition can have a desired particle size of the resultant toner particles by controlling stirring speed and/or stirring time. Thereafter, the stirring may be continued in such a degree as to retain the particles of the polymerizable monomer composition thus formed and prevent the sedimentation of the particles. The polymerization may be performed at a temperature of at least 40° C., generally 50–90° C. The temperature can be raised at a latter stage of the polymerization. It is also possible to subject a part of the aqueous system to distillation in a latter stage of or after the polymerization in order to remove the yet-polymerized part of the polymerizable monomer and a by-product. After the reaction, the produced toner particles are washed, filtered out, and dried. In the suspension polymerization, it is generally preferred to use 300–3000 wt. parts of the aqueous medium per 100 wt. parts of the monomer composition.

In the present invention, the toner particles are externally blended with an additive (external additive) to prepare the toner according to the present invention.

Examples of the (external) additive may include: fine powders of metal oxides or double oxides (such as aluminum oxide, titanium oxide, strontium titanate, cerium oxide, magnesium oxide, chromium oxide, tin oxide and zinc oxide); fine powders of nitrides (such as silicon nitride); fine powders of carbide (such as silicon carbide); fine powders of metal salts (such as calcium sulfate, barium sulfate and calcium carbonate); fine powders of fatty acid metal salts (such as zinc stearate, and calcium stearate); carbon black; and silica fine powder.

These (external) additives may be used singly or in combination and may preferably be hydrophobized (hydrophobicity-imparted) in view of improvement in environmental stability of the resultant toner. The additives may preferably have a BET specific surface area ($S_{BET}$) of 20–400 $m^2/g$.

Particularly, among the above additives, hydrophobic silica fine powder having a BET specific surface area ($S_{BET}$) of 20–400 $m^2/g$. Further, in combination with the hydrophobic silica fine powder, fine particles of inorganic oxides or double oxides having an average particle size of 0.1–3.0 $\mu$m, particularly those of strontium titanate or calcium titanate having an average particle size of 0.1–3.0 $\mu$m, may preferably be used.

The external additive used in the present invention may preferably be added in an amount of 0.01–10 wt. parts, more preferably 0.05–5 wt. parts per 100 wt. parts of the toner particles.

In order to produce the toner satisfying the above-mentioned properties ($C_1$, $C_2$, C, SF-1, SF-2 and $D_4$) in the present invention, toner particles may preferably be prepared by the suspension polymerization having a desired particle size and by controlling an amount of fine resin particles attached to the surfaces of the toner particles. The fine resin particles are formed as a by-product during the suspension polymerization and are attached to the toner particle surfaces at various strengths, so that fine resin particles weakly attached to the toner particle surfaces may preferably be detached therefrom as free fine resin particles by, e.g., a high-speed gas (air) stream and the free fine resin particles may preferably be removed by classification.

Hereinbelow, gas stream or pneumatic classifier and classifying system suitable for treating the toner particles with the high-speed air stream and removing the free fine resin particles as described above will be explained specifically with reference to FIGS. 5–10.

Figure 5:
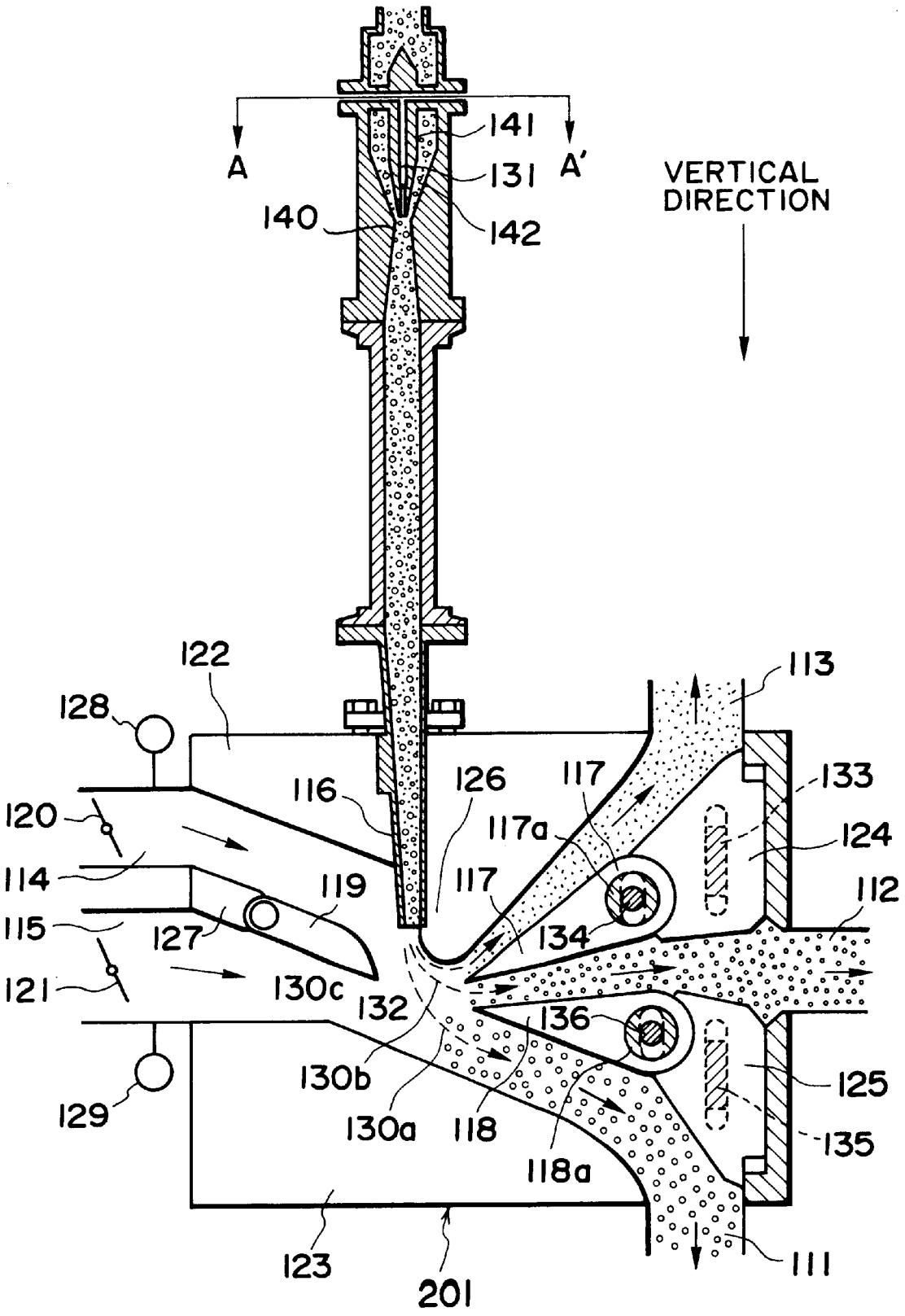
FIG. 5 is a schematic sectional view of a gas stream classifier utilizing the Coanda effect for controlling an amount of fine resin particles attached to toner particles.
Figure 6:
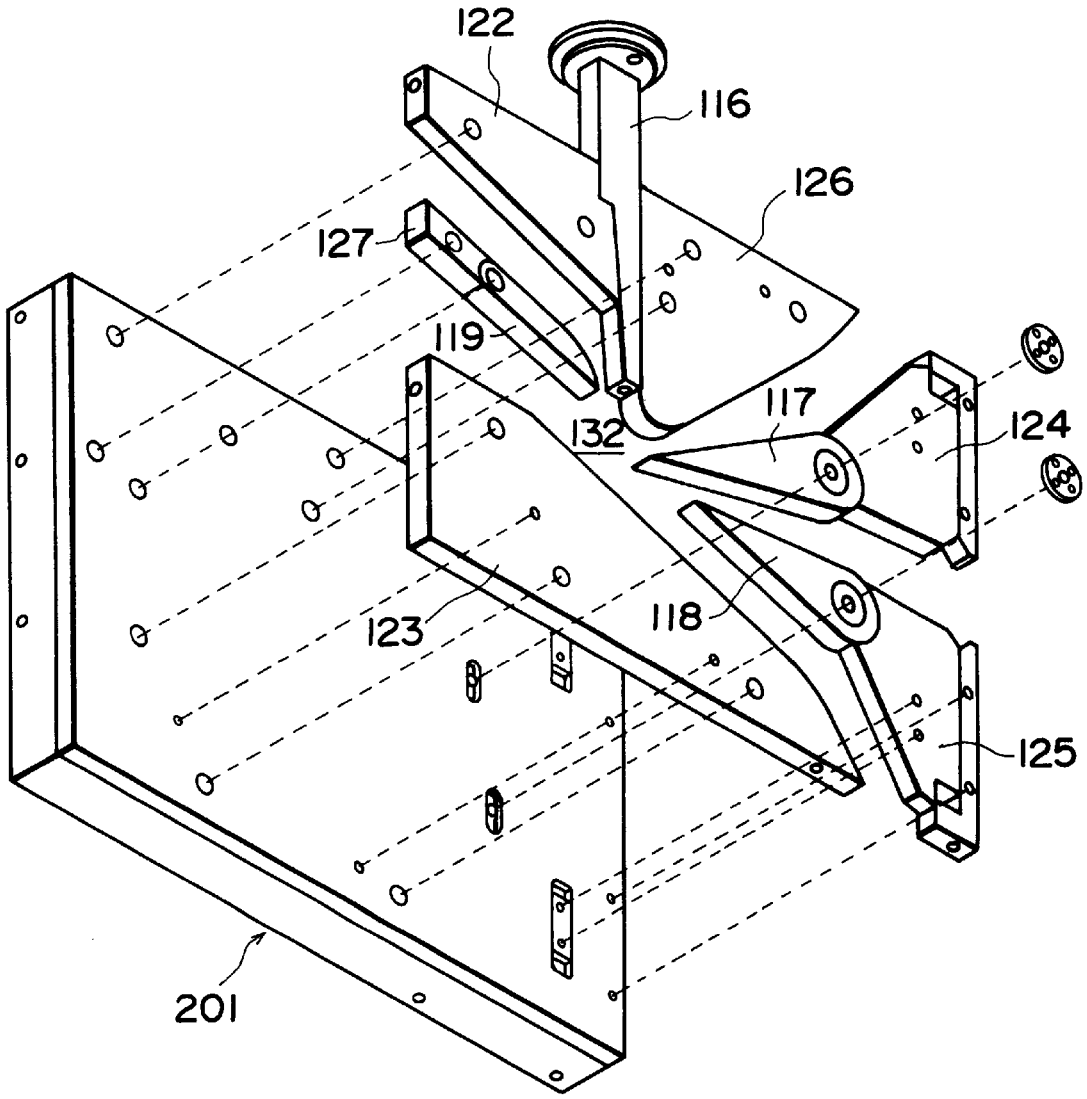
FIGS. 6 and 7 are respectively a perspective view of a part of the gas stream classifier shown in FIG. 5.
Figure 7:
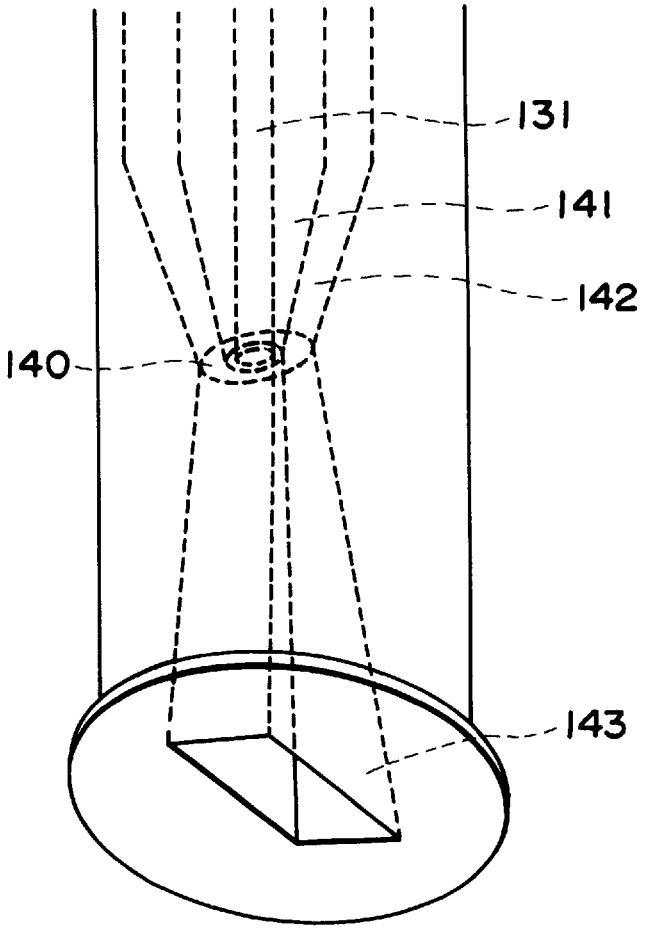
Figure 8:
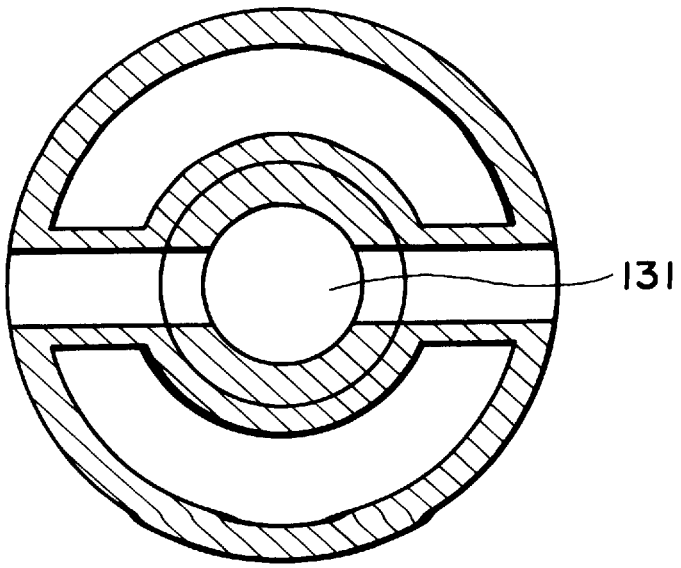
FIG. 8 is a plan view taken along A-A' line shown in FIG. 5.

An example of the gas stream (pneumatic) classifier used for preparing the toner of the present invention is shown in FIG. 5 (schematic sectional view) and FIGS. 6 and 7 (schematic perspective views).

In the gas stream classifier and the classifying system using the classifier, in general, a high-pressure air guide pipe and a feed powder guide nozzle are disposed at a rear end portion of a feed supply nozzle disposed at an inclination angle (θ) of at most 45 degrees with respect to a vertical direction. Toner particles (feed powder) are supplied from a feed supply port disposed at an upper section of the feed powder guide nozzle and spread out from a periphery of the high-pressure air guide pipe at a lower section of a feed powder introducing port. Thereafter, the toner particles are accelerated by the high-pressure air stream to be uniformly dispersed, thus detaching fine resin particles weakly attached to the toner particles therefrom to supply well dispersed (distributed) toner particles toward a feed (powder) supply nozzle.

Further, by appropriately modifying a shape of a classification zone, it is possible to extend the classification zone and largely change the number of classifying points and also to adjust the classifying position with accuracy without causing turbulent flow of the air stream in the vicinity of a classifying edge tip.

The introduction and discharge of the toner particles at a feed powder supply section are based on an eductor (ejector) effect due to a reduced pressure by expansion of the high-pressure air from the guide pipe thereof in the feed powder supply nozzle.

Referring to FIGS. 5, 6 and 7, side walls 122 and 123 from a part of a classifying chamber 132, and classifying edge blocks 124 and 125 are provided with knife-shaped classifying edges 117 and 118, respectively. The classifying edges 117 and 118 are rotatable around axes 117*a* and 118*a*, thus allowing change in their tip positions respectively. The classifying edge blocks 124 and 125 are capable of vertically changing (moving) their fixing positions, respectively. Depending on the changes of the positions, the corresponding classifying edges 117 and 118 are also vertically changed in their positions, respectively.

A classifying zone in the classifying chamber 132 is divided into three sections by the classifying edges 117 and 118.

A feed supply nozzle 116 having a feed supply (introducing) port 140 and a feed powder guide nozzle 142 which include a high-pressure air guide pipe 141 and a feed powder supply (introducing) port, at a rear (upper) end portion thereof and also having a supply port in the classifying chamber 132 is disposed on the right side of the side wall 122. On the right side of the feed supply nozzle 116, a Coanda block 126 is disposed so as to extend along a right-side tangential lien of the supply nozzle 116 and be folded upwardly to form a long elliptical arcuate section. A left-side block 127 of the classifying chamber 132 is provided with a knife-shaped intake edge 119. At the left-side portion of the classifying chamber 132, gas (air) intake pipes 114 and 115 are disposed so as to respectively open into the classifying chamber 132. The gas intake pipes 114 and 115 are equipped with first and second gas intake control means 20 and 21, such as dampers, respectively, and also with static pressure gauges 128 and 129, respectively.

The high-pressure air introduced into the high-pressure air guide pipe 141 may have a pressure 1.0–3.0 kg/cm$^2$ for ordinary classification but may preferably have a pressure of above 3.0 kg/cm$^2$, more preferably 3.5–6.0 kg/cm$^2$, for effectively detaching the fine resin particles attached to the surfaces of the toner particles and controlling a certain amount of those considerably strongly attached to the toner particle surfaces.

The positions of the classifying edges 117 and 118 and the gas intake edge 119 are controlled depending on the kind of the toner particles (feed powder) to be classified and the objective particle size.

At the right-hand portion of the classifying chamber 132, exhaust ports 111, 112 and 113 each opening into the classifying chamber 132 and connected to connecting means such as a pipe which is provided with a shutter means such as a valve.

The feed supply nozzle 116 comprises a straight(regular) tube section and a rectangular tapered tube section.

When the inner diameter of the straight tube section and that of the narrowest part of the rectangular tapered tube section are set to provide a ratio of 20:1 to 1:1, preferably 10:1 to 2:1, an appropriate injection (introduction) velocity can be attained.

A classifying operation in the above-designed multi (three)-division classifying zone may, e.g., be performed in the following manner.

A reduced pressure is generated in the classifying chamber 132 by evacuation through at least one of the exhaust ports 111, 112 and 113 and supplying (jetting) the feed powder through the feed supply nozzle 116 opening into the chamber 132 together with an accompanying gas stream flowing at a speed of 50–300 m/sec under the action of the high-pressure air and the reduced pressure into the chamber 132.

The (toner) particles of the feed power thus supplied are caused to move along curved lines 130*a*, 130*b* and 130*c* due to the Coanda effect given by the Coanda block 126 and the action of the accompanying gas stream (such as air stream), and depending on the particle sizes and inertial forces of individual particles, is divided into a coarse (first) powder fraction (over the prescribed particle size range) falling outwardly (i.e., the outside the classifying edge 118), a medium (second) powder fraction (within the prescribed particle size range) falling between the classifying edges 117 and 118, and a fine (third) powder fraction falling inside the classifying edge 117. Then, the coarse powder fraction, the medium powder fraction and the fine powder fraction are discharged through the exhaust ports 111, 112 and 113, respectively.

In the above classification of the toner particles, the classifying points are principally determined by the tip positions of the classifying edges 117 and 118 relative to the arcuate section (lower portion) of the Coanda block 126 where the toner particles are ejected. Further, the classifying points are also affected by a flow rate of the gas stream for classification and the ejection speed of the toner particles from the feed supply nozzle 116.

In the gas stream classifier described above, the toner particles are supplied from the periphery of the high-pressure air guide pipe 141 (the lower portion of the feed powder guide section 142) through the feed supply port 140 and are accelerated along the high-pressure air stream ejected from the high-pressure air guide pipe 141 to be well dispersed in the feed supply nozzle 116. The dispersed toner particles are immediately introduced into the classifying chamber 132, classified therein and discharged outside the classifier.

For this reason, it is important for the toner particles supplied to the classifier to be flown with a prescribed propulsive power in such a state that the aggregated (agglomerated) particles are dispersed into primary particles while flying or flowing along a prescribed flowing route for the individual particles without being disturbed by the position of the introduction port of the feed supply nozzle 116 within the classifying chamber 132.

In the case where the toner particles are supplied from the upper portion of the classifying chamber 132, the particle flow trace from the feed supply nozzle 116 into the chamber 132 is not disturbed since the Coanda block 126 is disposed at the lateral position of the opening (supply port) of the feed supply nozzle 116, thus forming a controlled particle flow comprising divided particle fractions depending on the particle sizes. Accordingly, the movable classifying edges 117 and 118 are moved in the directions each along the corresponding particle flow and the tip portions thereof are correspondingly fixed thereat, respectively, thus setting the prescribed classifying points.

When the classifying edges 117 and 118 are moved, it is possible to provide the respective edge directions, of the edges 117 and 118, each along the corresponding particle flow along the Coanda block 126, by moving the classifying edge blocks 124 and 125 simultaneously.

Figure 9:
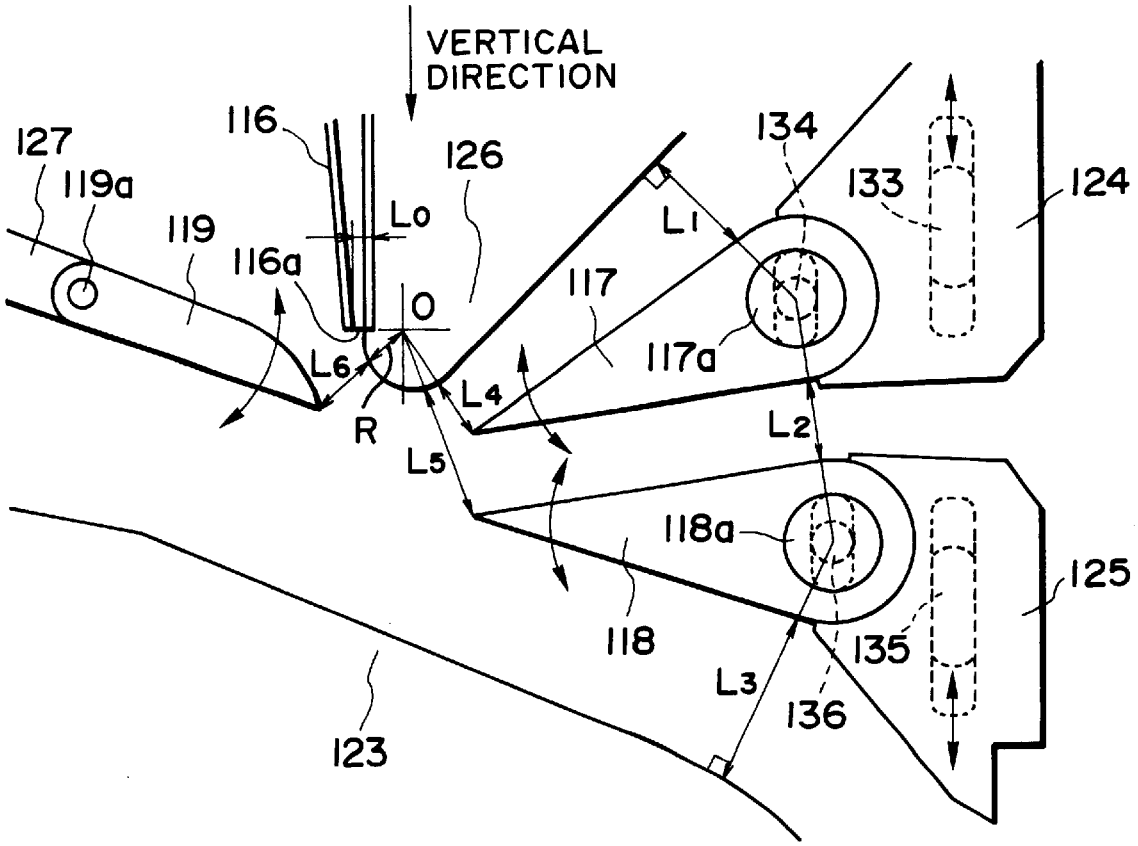
FIG. 9 is a sectional view showing a principal part of the classifier shown in FIG. 5.

More specifically, as shown in FIG. 9 where an enlarged classifying zone is illustrated, based on a prescribed position (e.g., a position 0) in the Coanda block 126 on a level with an opening tip portion 116*a* of the feed supply nozzle 116 disposed along the Coanda block 126, a distance $L_4$ between the tip of the classifying edge 117 and the side of the Coanda block 126 and a distance $L_1$ between the sides of the classifying edge 117 and Coanda black 126 can be controlled by vertically moving the classifying edge block 124 along a positioning member 133 to vertically move the classifying edge 117 along a positioning member 134 and by rotatably moving the tip of the classifying edge 117 around the axis 117*a*.

Similarly, a distance $L_5$ between the tip of the classifying edge 118 and the arcuate side of the Coanda block 126, a distance $L_2$ between the sides of the classifying edges 117 and 118, and/or a distance $L_3$ between the side of the classifying edge 118 and the side of the side wall 123 can be controlled by vertically moving the classifying edge block 125 along a positioning member 135 to vertically move the classifying edge 118 along a positioning member 136 and by rotatably moving the tip of the classifying edge 118 around the axis 118*a*.

By disposing the Coanda block 126 along the side of the feed supply nozzle 116 having the opening tip portion 116*a* and disposing the classifying edges 117 and 118 disposed at the prescribed distances from the Coanda block 126 in addition to the changes in fixed position of the classifying edge block 124 or/and the classifying edge block 125, it is possible to appropriately extend the classifying zone in the classifying chamber and also to readily and largely change the prescribed classifying points as described above.

As a result, it is possible to prevent a disturbed particle flow caused by the tips of the classifying edges 117 and 118. Further, it is also possible to increase the particle flow speed in the classifying zone by controlling a flow rate of a suction flow due to a reduced pressure through the exhaust ports (111, 112 and 113 shown in FIG. 5), thus further improving a dispersibility (distribution degree) of the toner particles in the classifying zone. Accordingly, it is possible to attain a high classification accuracy even in the case of a high feed powder density, thus not only suppressing a lowering in production yield but also enhancing the classification accuracy and the production yield even at the same powder density when compared with the conventional classifying system.

Referring again to FIG. 9, a distance $L_6$ between the tip of the gas intake edge 119 and the arcuate side of the Coanda block 126 can be controlled by rotatably moving the tip of the gas intake edge 119 around an axis 119*a*, so that it becomes possible to further control the classifying points or positions by controlling the amount and flow speed of the gas supplied through the gas intake pipes 114 and 115.

The above-described distances $L_1$ to $L_6$ may appropriately be set, respectively, depending upon properties of the toner particles to be classified.

In a preferred embodiment of the present invention, the distances $L_1$, $L_2$ and $L_3$ may desirably satisfy the following relationships together with an inner diameter $L_0$ of the opening tip portion 116*a* of the feed supply pipe 116 when the toner particles are non-magnetic toner particles.

(Case where true density of toner particles=0.3–1.4 g/cm$^3$)

$$L_0<L_1+L_2<nL_3 \text{ (n}\geqq 1\text{, real number)}$$

(Case where true density of toner particles>1.4 g/cm$^3$)

$$L_0<L_3<L_1+L_2$$

If the toner particles to be classified satisfy the above relationships, it becomes possible to efficiently obtain toner particles having a sharp particle size distribution.

The above-mentioned gas stream classifier is connected with peripheral devices each via connecting means such as a pipe, thus constituting a classifying (apparatus) system.

Figure 10:
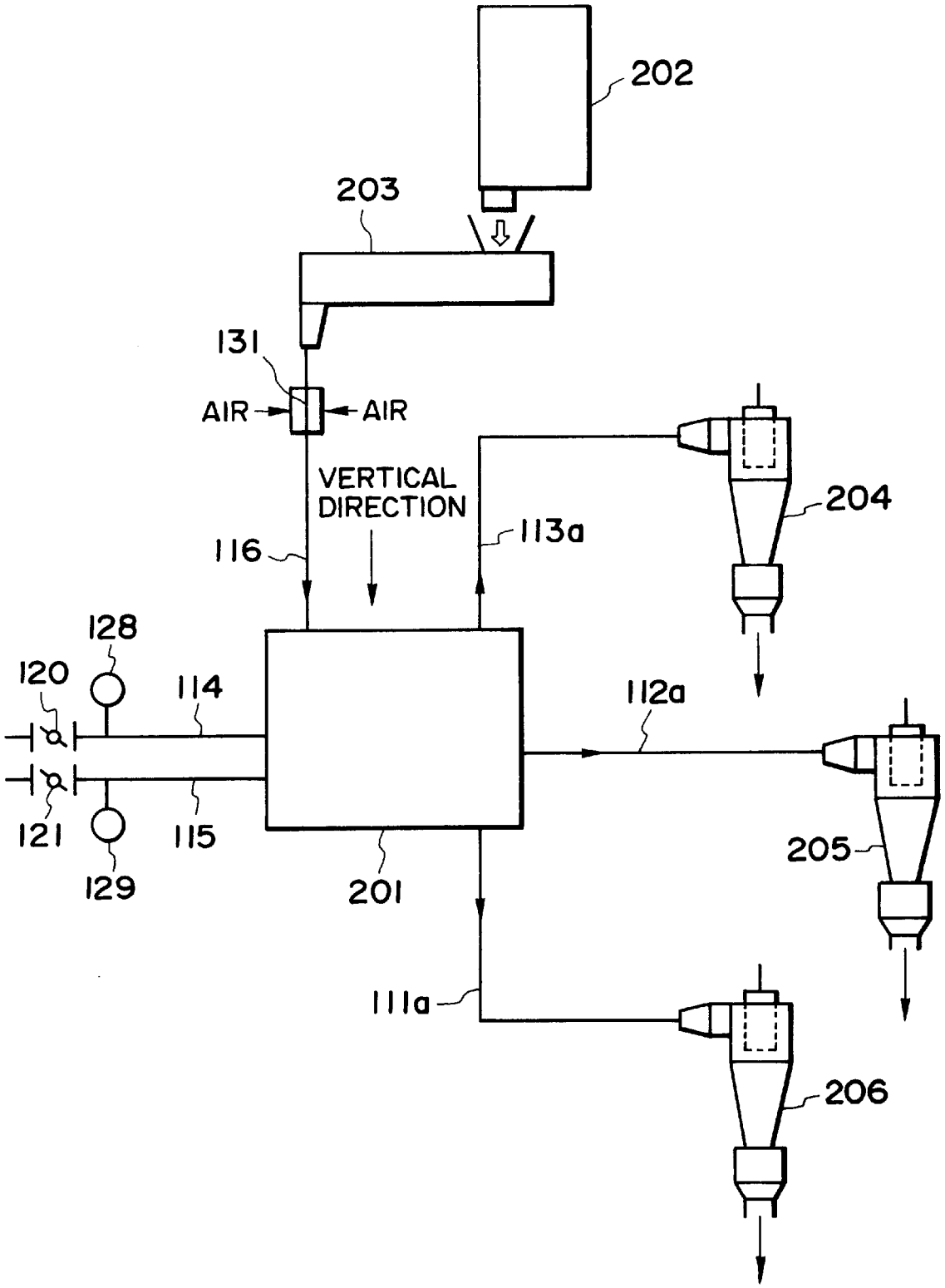
FIG. 10 is a schematic view for illustrating an embodiment of a classifying process used for classification of toner particles adopted in the present invention.

One of preferred embodiments of the classifying system is shown in FIG. 10.

Referring to FIG. 10, the classifying system principally include a three-division classifier 201 (as shown in FIGS. 5–9), a metering feeder 202, a vibration feeder 203, and collecting cyclones 204, 205 and 206 each connected to the classifier 201 via connecting means.

In this system (apparatus), the toner particles (feed powder) are introduced into the metering feeder 202 by appropriate means and supplied into the three-division classifier 201 via a feed supply nozzle 116 at a feeding speed of, e.g., 50–300 m/sec. The classifier 201 has a classifying chamber of (10–50 cm)×(10–50 cm) in size in general, thus dividing the feed powder into three (or more) particle (powder) fractions instantly, e.g., in 0.01–0.1 sec. As a result, the feed powder is instantly classified into a coarse powder fraction, a medium powder fraction and a fine powder fraction. Thereafter, the coarse powder fraction is discharged via an exhaust pipe 111*a* to be collected by the collecting cyclone 206. Similarly, the medium powder fraction is discharged via an exhaust pipe 112*a* to be collected y the collecting cyclone 205, and the fine powder fraction is discharged via an exhaust pipe 113*a* to be collected by the collecting cyclone 204. These collecting cyclones 204, 205 and 206 may also function as suction means for pressure decrease so that the feed powder is introduced by suction force into the classifying chamber via the feed supply nozzle 116.

Hereinbelow, the image forming method according to the present invention using the above-described toner will be described based on FIGS. 1–3.

FIG. 1 shows a color image forming apparatus (e.g., a copying machine or a laser been printer) utilizing an electrophotographic process wherein an elastic roller having a medium resistance is used as an intermediate transfer member. FIG. 2 shows a color image forming apparatus (e.g., a copying machine or a laser beam printer) using a belt having an medium resistance as an intermediate transfer member.

Figure 2:
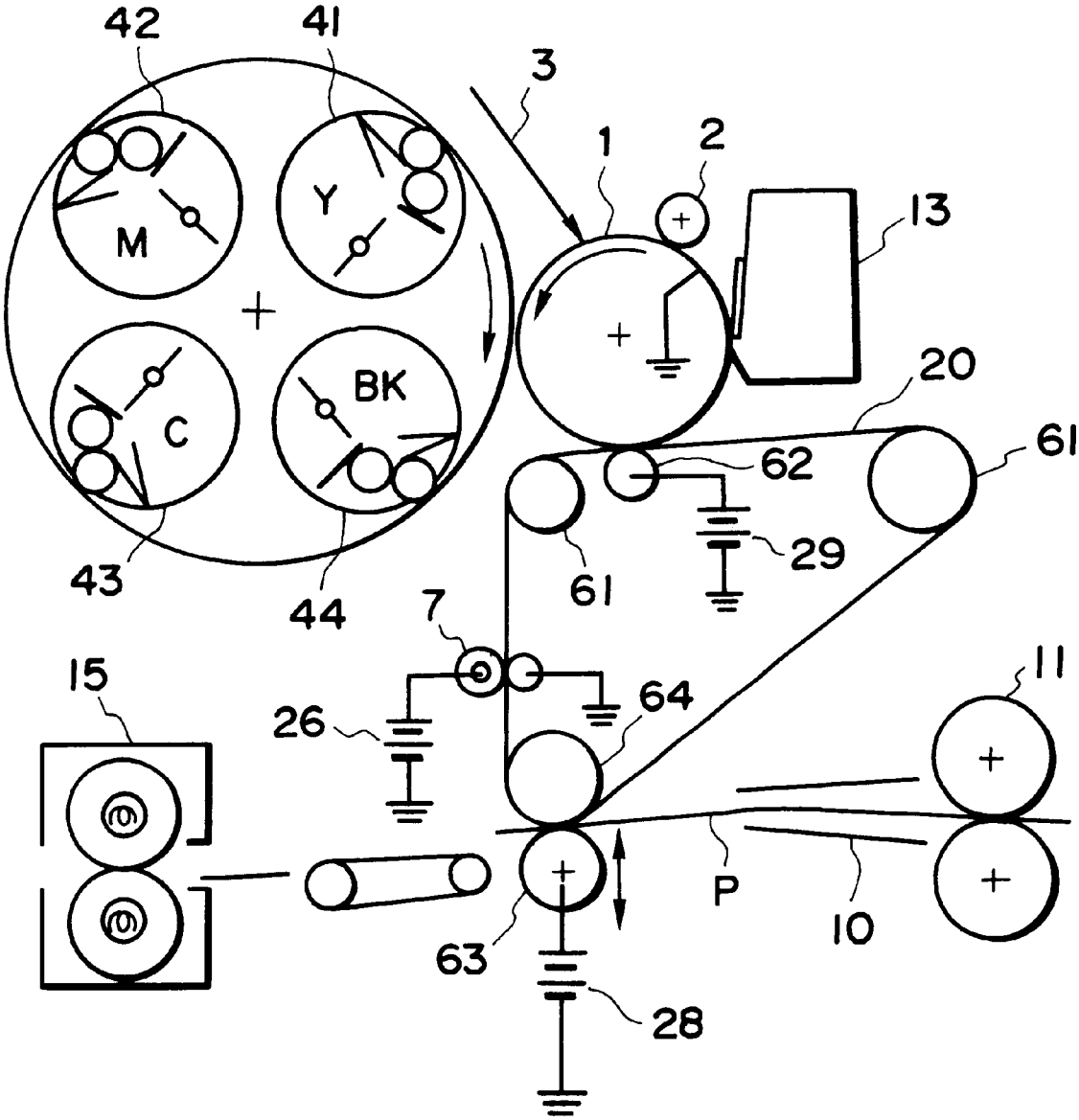
FIG. 2 is a schematic sectional view of another embodiment of an image forming apparatus, including a belt-shaped intermediate transfer member, suitable for the image forming method of the present invention.

Referring to FIGS. 1 and 2, the color image forming apparatus includes a photosensitive drum (photosensitive member) 1, a primary charger (charging means) 2, an imagewise exposure means 3, a secondary transfer belt 6, a recovering member 9 for recovering a residual toner after transfer, a guide 10 for a transfer-receiving material, a supply roller 11 for the transfer-receiving material, a cleaning unit (device) 13 for the photosensitive drum, a fixing device 15, an intermediate transfer member 20 (in ia drum shape for FIG. 1 and in a belt shape for FIG. 2), a core metal 21, an elastic layer 22, bias voltage supplies 26, 27, 28 and 29, a yellow (Y) color developing unit 41, a magenta (M) color developing unit 42, a cyan (C) color developing unit 43, a black (Bk) color developing unit 44, tension rollers 61, and 64, a charging roller 62 (for charging the secondary transfer belt 6 in FIG. 1 and for charging the intermediate transfer belt 20 in FIG. 2), a transfer roller 63 and a transfer-receiving material P.

The drum-type photosensitive member 1 to be repetitively used as an image-bearing member is rotated at a prescribed peripheral (process) speed in a counterclockwise direction as shown by the indicated arrow. During the rotation, the photosensitive drum 1 is uniformly charged by the primary charger 2 so as to have prescribed polarity and potential and then is imagewisely exposed to light 3 by imagewise exposure means (not shown) (as by exposure optical system effecting color separation and imaging of an original color image or by scanning exposure system outputting a laser beam modulated correspondingly to a time-serial electric digital pixel (picture) signal for image data), thus forming thereon an electrostatic (latent) image corresponding to a first color component image (e.g., a yellow color component image) of an objective color image.

Then, the (yellow color) electrostatic (latent) image is developed with a yellow toner Y by a first (yellow color) developing unit 41. At this time, other second to fourth (magnet color, cyan and black color) developing units 42, 43 and 44 are in a "OFF" state, thus not affecting the photosensitive drum 1. As a result, the first yellow color image is not affected by the second to fourth developing units 42, 43 and 44.

Each of the first to fourth developing units 41–44 includes a toner-carrying member, toner application means for applying the toner onto the surface of the toner-carrying member, and a toner vessel for holding or containing the toner. Each developing unit can be formed in a developing apparatus unit integrally including the toner-carrying member, the toner application means and the toner vessel. The thus formed developing apparatus unit is detachably mountable to a main body of the image forming apparatus.

Next, an example of a non-magnetic monocomponent developing method performed by using the toner of the present invention will be described with reference to FIG. 3.

Figure 3:
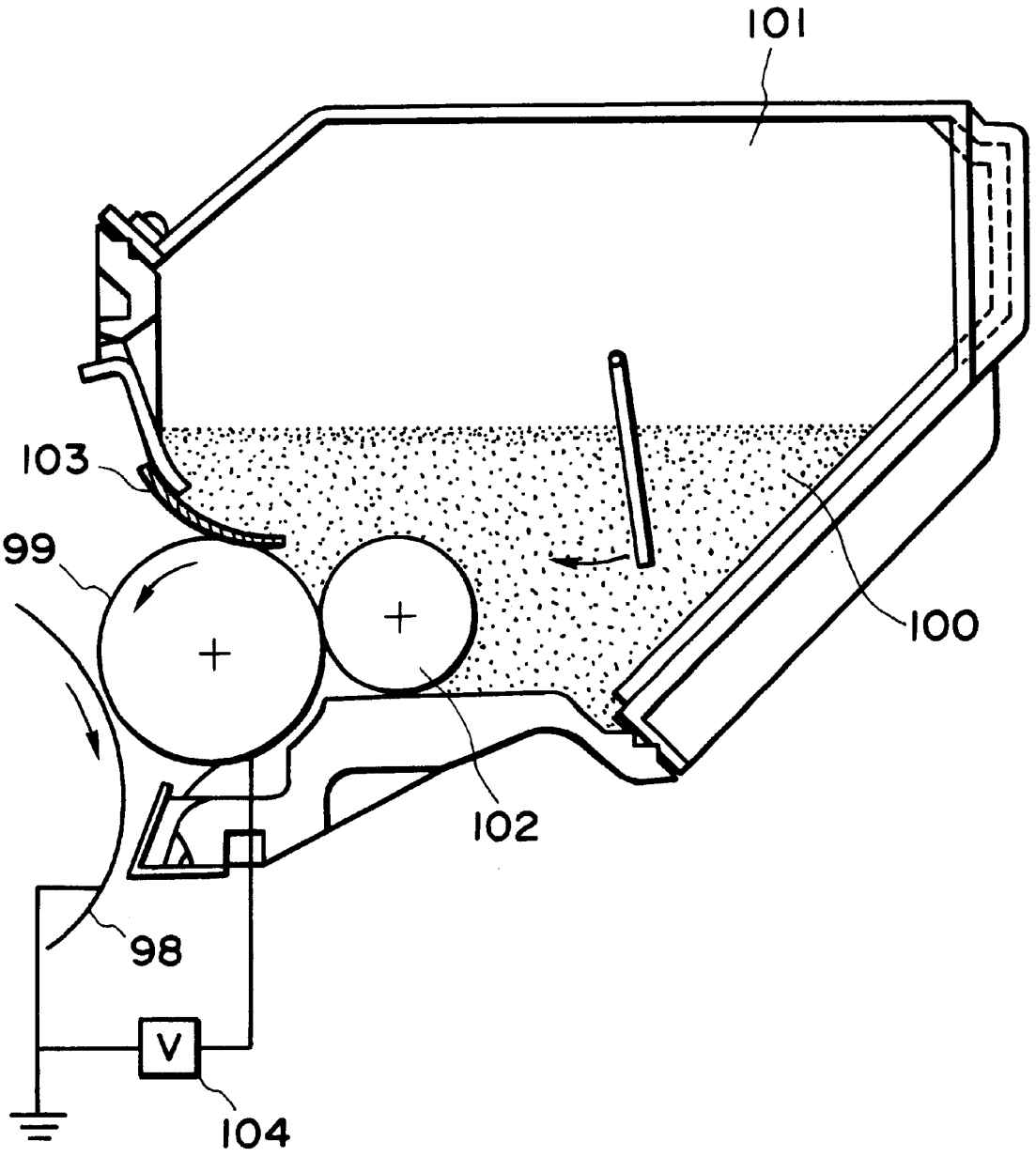
FIG. 3 is a schematic sectional view of an embodiment of a developing apparatus unit, for effecting mono-component non-magnetic developing, according to the present invention.

FIG. 3 shows a developing apparatus unit (developing unit) and a part of an adjacent photosensitive drum.

The electrostatic image formed, according to electrophotography or electrorecording on the photosensitive drum as an electrostatic image-bearing member 98, is developed by the developing apparatus unit shown in FIG. 3.

The developing apparatus unit includes a developing sleeve (toner-carrying member) 99 comprising a non-magnetic sleeve of, e.g., aluminum or stainless steel. The developing sleeve 99 may comprise a crude pipe or cylinder of aluminum or stainless steel. Further, the surface of such a pipe may be uniformly roughened by blasting with glass beads, mirror-finished or coated with a resin composition.

A toner 100 is contained or held by a hopper (toner vessel) 101 and supplied to the developing sleeve by means of a toner supply roller 102. The toner supply roller is made of a foamed material such as a polyurethane foam and is rotated in a direction identical or opposite to that of the developing sleeve 99 at a prescribed peripheral speed (not zero) relative to that of the developing sleeve 99. As a result, the toner supply roller 102 also has a function of removing the toner after the developing operation (i.e., undeveloped toner) in addition to the toner supply. The toner supplied onto the developing sleeve 99 is formed in a uniform and small thickness by a toner (or developer) application blade 103.

The toner application blade 103 may preferably comprise a material providing a triboelectric chargeability suitable for charging the toner to have a desired polarity. The toner application blade 103 may suitably be composed of silicone rubber, urethane rubber, styrene-butadiene rubber, etc., and may optionally be coated with an organic layer of a resin, such as polyamide, polyimide, nylon, melamine, melamine-crosslinked nylon, phenolic resin, fluorine-containing resin, silicone resin, polyester resin, urethane resin or styrene-based resin. It is also possible to use an electroconductive rubber, an electroconductive resin, etc.

In the above-mentioned rubbers or resins, a filler or charge (e.g., metal oxides, carbon black, inorganic whiskers or inorganic fibers) may preferably be dispersed to impart an appropriate electroconductivity or charge-imparting characteristic to the toner application blade, thus appropriately charging the toner employed.

Referring again to FIG. 1, the intermediate transfer roller (member) 20 comprise the core metal 21 in a form of a pipe and the elastic layer 22 formed on the peripheral surface of the core metal 21, and is rotated in a clockwise direction as shown by the indicated arrow at a peripheral speed identical to that of the photosensitive drum 1 while mating with the photosensitive drum 1.

The yellow (first) toner image formed and held on the photosensitive drum 1 is temporarily transferred onto the intermediate transfer member 20 by the action of an electric field formed by a primary transfer bias voltage applied to the intermediate transfer member 20 when passed through a nip portion between the photosensitive drum 1 and the intermediate transfer member 20. In a similar manner, a second (magenta) toner image, a third (cyan) toner image, and a fourth (black) toner image are successively transferred onto the intermediate transfer member 20 to form a superposed color toner image corresponding to an objective color image.

The primary transfer bias voltage for the successive transfer of the first o fourth toner images from the photosensitive drum 1 to the intermediate transfer member 20 has a polarity (positive) opposite to that (negative) of the toner and is supplied from the bias voltage supply 29.

During the above successive transfer step, the transfer belt 6 is in a state contactable to the intermediate transfer member 20.

The transfer belt 6 is disposed beneath the intermediate transfer member 20 so as to contact the lower portion thereof and is supported by the transfer roller 62 and the tension roller 61 each having a shaft arranged in parallel with that of the intermediate transfer member 20. The transfer roller 62 is supplied with a prescribed secondary transfer bias voltage by the bias voltage supply 28, and the tension roller 61 is grounded.

Transfer of the superposed toner image formed on the intermediate transfer member 20 by the successive transfer onto the transfer-receiving material P is performed as follows When the transfer belt 6 abuts against the intermediate transfer member 20, the transfer-receiving material P is supplied with a prescribed timing to the abutting nip portion between the transfer belt 6 and the intermediate transfer member 20 from a paper-supplying cassette (not shown) via the supply rollers 11 and guide 10 for the transfer-receiving material P while applying the second transfer bias voltage from the bias voltage supply 28 to the transfer roller 62. The superposed color toner image is transferred from the intermediate transfer member 20 onto the transfer-receiving material P by the action of the second transfer bias voltage, and then is supplied in the fixing device 15 to be heat-fixed.

FIG. 2 shows the color image forming apparatus using the belt-shaped intermediate transfer member.

Referring to FIG. 2, the drum-type photosensitive member 1 to be repetitively used as an image-bearing member is rotated at a prescribed peripheral (process) speed in a counterclockwise direction as shown by the indicated arrow. During the rotation, the photosensitive drum 1 is uniformly charged by the primary charger 2 so as to have prescribed polarity and potential and then is imagewisely exposed to light 3 by imagewise exposure means (not shown) (as by exposure optical system effecting color separation and imaging of an original color image or by scanning exposure system outputting a laser beam modulated correspondingly to a time-serial electric digital pixel (picture) signal for image data), thus forming thereon an electrostatic (latent) image corresponding to a first color component image (e.g., a yellow color component image) of an objective color image.

Then, the (yellow color) electrostatic (latent) image is developed with a yellow toner Y by a first (yellow color) developing unit 41. At this time, other second to fourth (magnet color, cyan and black color) developing units 42, 43 and 44 are in a "OFF" state, thus not affecting the photosensitive drum 1. As a result, the first yellow color not affected by the second to fourth developing units 42, 43 and 44.

The intermediate transfer belt (member) 20 is rotated in a clockwise direction at a peripheral speed identical to that of the photosensitive drum 1 while mating with the photosensitive drum 1.

The yellow (first) toner image formed and held on the photosensitive drum 1 is temporarily transferred onto the intermediate transfer member 20 by the action of an electric field formed by a primary transfer bias voltage applied from the primary transfer roller 62 to the intermediate transfer member 20 when passed through a nip portion between the photosensitive drum 1 and the intermediate transfer member 20. After the transfer of the yellow toner image, the surface of the photosensitive drum 1 is cleaned by the cleaning device 13. In a similar manner, a second (magenta) toner image, a third (cyan) toner image, and a fourth (black) toner image are successively transferred onto the intermediate transfer member 20 to form a superposed color toner image corresponding to an objective color image.

The secondary transfer roller 63 is disposed beneath the intermediate transfer member 20 in a contactable state thereto and disposed opposite to the secondary transfer opposite roller 64 so that the rollers 63 and 64 are born by respective shafts in parallel with each other.

The primary transfer bias voltage (e.g., in a range of +100 V to +2 kV) for the successive transfer of the first o fourth toner images from the photosensitive drum 1 to the intermediate transfer member 20 has a polarity (positive) opposite to that (negative) of the toner and is supplied from the bias voltage supply 29.

During the above successive transfer step, the secondary transfer roller 63 and the cleaner 13 for the intermediate transfer member 20 are in a state contactable to the intermediate transfer member 20.

Transfer of the superposed toner image formed on the intermediate transfer member 20 by the successive transfer onto the transfer-receiving material P as a second image-bearing member is performed as follows.

When the secondary transfer roller 63 abuts against the intermediate transfer member 20, the transfer-receiving material P is supplied with a prescribed timing to the abutting nip portion between the secondary transfer roller 63 and the intermediate transfer member 20 from a paper-supplying cassette (not shown) via the supply rollers 11 and guide 10 for the transfer-receiving material P while applying the second transfer bias voltage from the bias voltage supply 28 to the secondary transfer roller 63. The superposed color toner image is transferred from the intermediate transfer member 20 onto the transfer-receiving material P by the action of the second transfer bias voltage, and then is supplied in the fixing device 15 to be heat-fixed.

The developing apparatus unit shown in FIG. 3 includes the developing sleeve 99, the (toner) application blade 103, the application roller 102, the toner 100 and the toner vessel 101 and is detachably mountable to a main body of the image forming apparatus of the present invention.

Referring to FIG. 3, the developing sleeve 99 is supplied with a bias voltage from the bias voltage application means 104 while mating with the electrostatic image-bearing member 98.

Hereinbelow, the present invention will be described more specifically with reference to Examples and Comparative Examples.

EXAMPLE 1

Into 700 wt. parts of deionized water, 450 wt. parts of a 0.1M-$Na_3PO_4$ aqueous solution was added, and the mixture was warmed at 60° C. Then, the mixture was stirred by a particle-forming device ("CLEAR MIX", mfd. by M. Technique Co., Ltd.) at the rate (number) of rotation of a stirring blade of 15000 rμm. Into the mixture, 68 wt. parts of a 1.0M-$CaCl_2$ aqueous solution was gradually added to prepare an aqueous dispersion medium containing calcium phosphate.

Separately, a polymerizable monomer composition was prepared as follows.

| | |
|---|---|
| Styrene (polymerizable monomer) | 170 wt. parts |
| n-Butyl acrylate (polymerizable monomer) | 30 wt. parts |
| C. I. Pigment Blue 15:3 (cyan colorant) | 10 wt. parts |
| Dialkylsalicylic acid metal compound (negative charge control agent, "Bontron E84", mfd. by Orient Kagaku Kogyo K. K.) | 2 wt. parts |
| Saturated polyester resin (polar resin, acid value = 10 mgKOH/g, number-average molecular weight (Mn) = 6000, peak molecular weight (Mpeak) = 8500) | 15 wt. parts |
| Ester was | 35 wt. parts |

-continued

| |
|---|
| (low-softening point substance (release agent), principal peak absorption temperature = 65° C.) |

The above ingredients were warmed at 60° C. and were uniformly dispersed at 15000 rpm by means of the particle-forming device. To the dispersion, 7 wt. parts of 2,2'-azobis (2,4-dimethylvaleronitrile) was added to prepare a polymerizable monomer composition.

The polymerizable monomer composition was added into the above-prepared aqueous dispersion medium, followed by stirring for 10 min. at 60° C. and 9000 rpm in nitrogen ($N_2$) atmosphere by means of the particle-forming device to effect particle formation of the polymerizable monomer composition. Thereafter, under stirring with a paddle mixer, the particles of the monomer composition were subjected to polymerization at 70° C. for 10 hours.

After the polymerization reaction, a residual (unpolymerized) monomer component of the monomer composition was distilled off at 80° C. under reduced pressure and then was cooled. To the resultant system, hydrochloric acid was added to dissolve calcium phosphate, followed by filtration, washing with water and drying to obtain cyan toner particles (A-1).

At the surfaces of the thus-prepared cyan toner particles (A-1), fine resin particles each comprising styrene-n-butyl acrylate copolymer formed as a by-product during the particle formation were found to be attached thereto through microscopic observation (magnification=10,000).

The cyan toner particles (A-1) comprised ca. 5 wt. parts of the cyan colorant, ca. 1 wt. part of the charge control agent, ca. 7.5 wt. parts of the polar resin and ca. 15 wt. parts of the low-softening point substance based on 100 wt. parts of the styrene-n-butyl acrylate copolymer.

The cyan toner particles (A-1) showed a value $C_1$ of 52% by number (N. %), a value $C_2$ of 22% by number (N. %) to provide a value C (=($C_1/C_2$)×100) of 236 as a result of the FPIA (flow particle image analyzer) measurement.

Then, the cyan toner particles (A-1) were classified by a multi-division pneumatic classifier and a classifying system utilizing the Coanda effect as shown in FIGS. 5–10 (as specifically described hereinbelow) to control an amount of the fine resin particles attached to the surfaces of the cyan toner particles (A-1), thus preparing cyan toner particles (A-2).

As a result of the FPIA measurement, the cyan toner particles (A-2) provided a value $C_1$ of 15 N. %, a value $C_2$ of 13 N. % and a value C of 115.

Further, the cyan toner particles (A-2) had a weight-average particle size ($D_4$) of 6.5 μm as obtained according to the CC (Coulter counter) measurement and provided a shape factor SF-1 of 110 and a shape factor SF-2 of 105.

Then, 100 wt. parts of the cyan toner particles (A-2) and 1.5 wt. parts of hydrophobic silica fine powder (external additive, a BET specific surface area ($S_{BET}$)=200 $m^2/g$ primary average particle size=0.01 μm) were blended to prepare a cyan toner No. 1.

The cyan toner No. 1 showed a $C_1$ of 15 N. %, a $C_2$ of 13 N. % and a C of 115 as a result of the FPIA measurement; a $D_4$ of 6.5 μm as a result of the CC measurement; and an SF-1 of 110 and an SF-2 of 105.

Further, it was confirmed that the increase from the $C_2$ value (13 N. %) to the $C_1$ value (15 N. %) was resulting from free fine particles of the styrene-n-butyl acrylate copolymer detached from the cyan toner particles (A-2).

In this example, the classification of the cyan toner particles (A-1) was performed by using the multi-division pneumatic classifier as follows.

Referring to FIGS. 5–10, the cyan toner particles (A-1) were fed or introduced from a (metering) feeder 202 into a multi (three)-division classifier 201 via a vibration feeder 203 and a feed supply nozzle 116 (including a feed powder-supplying section 142, a high-pressure air guide pipe 141 and a deformed tube section 143) at a feeding rate of 10 kg/hour in order to divide the cyan toner particles (A-1) into three fractions including a coarse powder fraction, a medium powder fraction (of the toner particles of the present invention) and a fine powder fraction by utilizing the Coanda effect.

The introduction (feeding) of the feed powder (cyan toner particles (A-1)) was effected by utilizing a suction force resulting from a reduced pressure within the system due to suction by collecting cyclones 204, 205 and 206 connected to exhaust pipes 111, 112 and 113 and utilizing a compressed air from an injection air guide pipe 131 of a high-pressure guide pipe 141 provided to the feed supply nozzle 116.

The compressed air introduced into the high-pressure air guide pipe 141 was set to provide a pressure of 5.0 $kg/cm^2$.

When the cyan toner particles (A-1) introduced from a feed supply port 14 contact the compressed air, fine particles of the styrene-n-butyl acrylate copolymer weakly attached to the surfaces of the cyan toner particles (A-2) are detached therefrom to be removed as free fine resin particles in this multi-division classifying step. As a result, only fine particles of the styrene-n-butyl acrylate copolymer strongly attached to the surfaces of the cyan toner particles (A-1) at a strong attaching force more than a certain level still remain on the cyan toner particle surfaces.

In the classifying step; principal distances or spacings between respective members at a classifying section ($L_0$, $L_1$, $L_2$, $L_3$, $L_4$, $L_5$, $L_6$ and R shown in FIG. 9) were set as follows.

$L_0$=6 mm (a diameter of a supply port 116*a* of the feed supply nozzle 116)

$L_1$=25 mm (a distance between a side (side surface) of a classifying edge 117 and a side of a Coanda block 126)

$L_2$=20 mm (a distance between a side of the classifying edge 117 and a side of a classifying edge 118)

$L_3$=25 mm (a distance between a side of the classifying edge 118 and a side of a side wall 123)

$L_4$=16 mm (a distance between tip of the classifying edge 117 and a side of the Coanda block 126)

$L_5$=30 mm (a distance between a tip of the classifying edge 118 and an arced side of the Coanda block 126)

$L_6$=25 mm (a distance between a tip of an inlet edge 119 and an arced side of the Coanda block 126)

R=8 mm (a radius of the arced portion of the Coanda block 126)

EXAMPLE 2

Cyan toner particles (A-3) were prepared by classifying the cyan toner particles (A-1) in the same manner as in Example 1 except that the pressure of the compressed air introduced into the high-pressure air guide pipe 141 was changed to 4.5 $kg/cm_2$.

The cyan toner particles (A-3) provided a $C_1$ of 23 N %, a $C_2$ of 18 N. % and a C of 128 as a result of the FPIA measurement.

Further, the cyan toner particles (A-3) had a $D_4$ of 6.4 μm as obtained according to the CC measurement and provided an SF-1 of 110 and an SF-2 of 108.

Then, 100 wt. parts of the cyan toner particles (A-3) and 1.5 wt. parts of hydrophobic silica fine powder (external additive, an $S_{BET}$=200 $m^2/g$) were blended to prepare a cyan toner No. 2.

The cyan toner No. 2 showed a $C_1$ of 23 N. %, a $C_2$ of 18 N. % and a C of 128 as a result of the FPIA measurement; a D4 of 6.4 μm as a result of the CC measurement; and an SF-1 of 110 and an SF-2 of 108.

EXAMPLE 3

Cyan toner particles (A-4) were prepared by classifying the cyan toner particles (A-1) in the same manner as in Example 1 except that the pressure of the compressed air introduced into the high-pressure air guide pipe 141 was changed to 4.0 $kg/cm^2$.

The cyan toner particles (A-4) provided a $C_1$ of 37 N %, a $C_2$ of 26 N. % and a C of 142 as a result of the FPIA measurement.

Further, the cyan toner particles (A-4) had a $D_4$ of 6.2 μm as obtained according to the CC measurement and provided an SF-1 of 110 and an SF-2 of 110.

Then, 100 wt. parts of the cyan toner particles (A-4) and 1.5 wt. parts of hydrophobic silica fine powder (external additive, an $S_{BET}$=200 $m^2/g$) were blended to prepare a cyan toner No. 3.

The cyan toner No. 3 showed a $C_1$ of 37 N. %, a $C_2$ of 26 N. % and a C of 142 as a result of the FPIA measurement; a D4 of 6.3 μm as a result of the CC measurement; and an SF-1 of 110 and an SF-2 of 110.

COMPARATIVE EXAMPLE 1

100 wt. parts of the cyan toner particles (A-1) (prepared in Example 1) and 1.5 wt. parts of hydrophobic silica fine powder (external additive, an $S_{BET}$=200 $m^2/g$) were blended to prepare a comparative cyan toner No. 1.

The comparative cyan toner No. 1 showed a $C_1$ of 52 N. %, a $C_2$ of 22 N. % and a C of 236 as a result of the FPIA measurement; a D4 of 6.2 μm as a result of the CC measurement; and an SF-1 of 108 and an SF-2 of 110.

COMPARATIVE EXAMPLE 2

Cyan toner particles (A-5) were prepared by classifying the cyan toner particles (A-1) in the same manner as in Example 1 except that, after the distilling-off (at 80° C. under reduced pressure) of the residual (unpolymerized) monomer component, the reaction system was heat-treated at 120° C. for 10 hour under pressure application.

The cyan toner particles (A-5) provided a $C_1$ of 2 N %, a $C_2$ of 2 N. % and a C of 100 as a result of the FPIA measurement.

Further, the cyan toner particles (A-5) had a $D_4$ of 6.3 μm as obtained according to the CC measurement and provided an SF-1 of 105 and an SF-2 of 108.

Then, 100 wt. parts of the cyan toner particles (A-5) and 1.5 wt. parts of hydrophobic silica fine powder (external additive, an $S_{BET}$=200 $m^2/g$) were blended to prepare a comparative cyan toner No. 2.

The comparative cyan toner No. 2 showed a $C_1$ of 2 N. %, a $C_2$ of 2 N. % and a C of 100 as a result of the FPIA measurement; a D4 of 6.3 μm as a result of the CC measurement; and an SF-1 of 105 and an SF-2 of 108.

COMPARATIVE EXAMPLE 3

200 wt. parts of a styrene-n-butyl acrylate copolymer (weight ratio=85:15, weight-average molecular weight (Mw)=125000, Mn=35000), 10 wt. parts of a cyan colorant (C.I. Pigment Blue 15:3), 2 wt. parts of a negative charge control agent ("Bontron E-84", mfd. by Orient Kagaku Kogyo K.K.), 15 wt. parts of a saturated polyester resin (polar resin, acid value=10 mgKOH/g, Mn=6000, Mpeak=8500) and 35 wt. parts of an ester wax (low-softening point substance, principal peak absorption temperature=65° C.) were sufficiently blended and were melt-kneaded through a twin-screw extruder. The melt-kneaded product was cooled and coarsely crushed by a hammer mill to obtain a coarsely crushed product (1 mm mesh size), followed by pulverization through a mechanical pulverizer to obtain a pulverized product ($D_4$=ca. 25 μm). The pulverized product was further finely pulverized by a jet air stream-type fine pulverizer to obtain a finely pulverized product ($D_4$=6.5 μm).

The finely pulverized product was classified by using the multi-division classifier (and classifying system) as shown in FIGS. 5–10 in the same manner as in Example 1 except that the pressure of the compressed air introduced into the high-pressure air guide pipe 141 was changed to 2.0 $kg/cm^2$ to obtain cyan toner particles (A-6).

The cyan toner particles (A-6) provided a $C_1$ of 9 N %, a $C_2$ of 9 N. % and a C of 100 as a result of the FPIA measurement.

Further, the cyan toner particles (A-6) had a $D_4$ of 6.5 μm as obtained according to the CC measurement and provided an SF-1 of 163 and an SF-2 of 150.

Then, 100 wt. parts of the cyan toner particles (A-6) and 1.5 wt. parts of hydrophobic silica fine powder (external additive, an $S_{BET}$=200 $m^2/g$) were blended to prepare a comparative cyan toner No. 3.

The comparative cyan toner No. 3 showed a $C_1$ of 9 N. %, a $C_2$ of 9 N. % and a C of 100 as a result of the FPIA measurement; a D4 of 6.5 μm as a result of the CC measurement; and an SF-1 of 163 and an SF-2 of 150.

COMPARATIVE EXAMPLE 4

Cyan toner particles (A-7) were prepared by surface-treating the cyan toner particles (A-6) prepared in Comparative Example 3 by using a surface reformer ("Nara Hybridization System, NHS-1 type", produced by Nara Machinery Co., Ltd.).

The cyan toner particles (A-7) provided a $C_1$ of 4 N %, a $C_2$ of 4 N. % and a C of 100 as a result of the FPIA measurement.

Further, the cyan toner particles (A-7) had a $D_4$ of 7.2 μm as obtained according to the CC measurement and provided an SF-1 of 130 and an SF-2 of 145.

Then, 100 wt. parts of the cyan toner particles (A-7) and 1.5 wt. parts of hydrophobic silica fine powder (external additive, an $S_{BET}$=200 $m^2/g$) were blended to prepare a cyan toner No. 4.

The comparative cyan toner No. 4 showed a $C_1$ of 4 N. %, a $C_2$ of 4 N. % and a C of 100 as a result of the FPIA measurement; a D4 of 6.4 μm as a result of the CC measurement; and an SF-1 of 130 and an SF-2 of 145.

COMPARATIVE EXAMPLE 5

Cyan toner particles (A-8) were prepared in the same manner as in Comparative Example 3 except that the amount of the ester wax (low-softening point substance) was changed to 6 wt. parts.

The cyan toner particles (A-8) provided a $C_1$ of 9 N %, a $C_2$ of 9 N. % and a C of 100 as a result of the FPIA measurement.

Further, the cyan toner particles (A-8) had a $D_4$ of 6.4 μm as obtained according to the CC measurement and provided an SF-1 of 164 and an SF-2 of 148.

Then, 100 wt. parts of the cyan toner particles (A-2) and 1.5 wt. parts of hydrophobic silica fine powder (external additive, an $S_{BET}$=200 $m^2/g$) were blended to prepare a comparative cyan toner No. 5.

The comparative cyan toner No. 5 showed a $C_1$. of 9 N. %, a $C_2$ of 9 N. % and a C of 100 as a result of the FPIA measurement; a D4 of 6. 4 μm as a result of the CC measurement; and an SF-1 of 164 and an SF-2 of 148.

EXAMPLE 4

100 wt. parts of the cyan toner particles (A-2) (used in Example 1), 1.5 wt. parts of hydrophobic silica fine powder (external additive, an $S_{BET}$=200 $m^2/g$ primary average particle size=0.01 μm) and 0.5 wt. part of strontium titanate fine powder ($S_{BET}$=2.0 $m^2/g$, primary average particle size=1.2 μm) were blended to prepare a cyan toner No. 4.

The cyan toner No. 4 showed a $C_1$ of 15 N. %, a $C_2$ of 13.5 N. % and a C of 111 as a result of the FPIA measurement; a D4 of 6.6 μm as a result of the CC measurement; and an SF-1 of 110 and an SF-2 of 105.

EXAMPLES 5 AND 6

Cyan toner particles (A-9) and cyan toner particles (A-10) were prepared in the same manner as in Example 1 except that the suspension polymerization condition and the classifying condition were changed respectively.

By using the cyan toner particles (A-9) and the cyan toner particles (A-10), a cyan toner No. 5 (Example 5) and a cyan toner No. 6 (Example 6) were prepared, respectively, in the same manner as in Example 1.

The respective parameters ($C_1$, $C_2$, C, $D_4$, SF-1 and SF-2) for the cyan toner particles (A-1)–(A-10) are shown in Table 2 below and those for the cyan toners No. 1–No. 6 and the Comparative cyan toners No. 1–No. 5 are shown in Table 3 below.

TABLE 2

| Cyan toner particles | $C_1$ (N. %) | $C_2$ (N. %) | C | $D_4$ (μm) | SF-1 | SF-2 |
|---|---|---|---|---|---|---|
| A-1 | 52 | 22 | 236 | 6.2 | 108 | 110 |
| A-2 | 15 | 13 | 115 | 6.5 | 110 | 105 |
| A-3 | 23 | 18 | 128 | 6.4 | 110 | 108 |
| A-4 | 37 | 26 | 142 | 6.2 | 110 | 110 |
| A-5 | 2 | 2 | 100 | 6.3 | 105 | 108 |
| A-6 | 9 | 9 | 100 | 6.5 | 163 | 150 |
| A-7 | 4 | 4 | 100 | 7.0 | 130 | 145 |
| A-8 | 9 | 9 | 100 | 6.4 | 164 | 148 |
| A-9 | 9 | 7 | 128 | 9.5 | 115 | 108 |
| A-10 | 49 | 36 | 136 | 5.2 | 112 | 104 |

TABLE 3

| Ex. No. | Toner | $C_1$ (N. %) | $C_2$ (N. %) | C | $D_4$ (μm) | SF-1 | SF-2 |
|---|---|---|---|---|---|---|---|
| Ex. 1 | Cyan toner No. 1 | 15 | 13 | 115 | 6.5 | 110 | 105 |
| Ex. 2 | Cyan toner No. 2 | 23 | 18 | 128 | 6.4 | 110 | 108 |

TABLE 3-continued

| Ex. No. | Toner | $C_1$ (N. %) | $C_2$ (N. %) | C | $D_4$ (μm) | SF-1 | SF-2 |
|---|---|---|---|---|---|---|---|
| Ex. 3 | Cyan toner No. 3 | 37 | 26 | 142 | 6.3 | 110 | 110 |
| Comp. Ex. 1 | Comp. cyan toner No. 1 | 52 | 22 | 236 | 6.2 | 108 | 110 |
| Comp. Ex. 2 | Comp. cyan toner No. 2 | 2 | 2 | 100 | 6.3 | 105 | 108 |
| Comp. Ex. 3 | Comp. cyan toner No. 3 | 9 | 9 | 100 | 6.5 | 163 | 150 |
| Comp. Ex. 4 | Comp. cyan toner No. 4 | 4 | 4 | 100 | 7.2 | 130 | 145 |
| Comp. Ex. 5 | Comp. cyan toner No. 5 | 9 | 9 | 100 | 6.4 | 164 | 148 |
| Ex. 4 | Cyan toner No. 4 | 15 | 13.5 | 111 | 6.6 | 110 | 105 |
| Ex. 5 | Cyan toner No. 5 | 9 | 7 | 128 | 9.5 | 115 | 108 |
| Ex. 6 | Cyan toner No. 6 | 49 | 36 | 136 | 5.2 | 112 | 104 |

EXAMPLES 7–12 AND COMPARATIVE EXAMPLES 6–10

Each of the cyan toner Nos. 1–6 and the comparative cyan toner Nos. 1–5 (prepared in Examples 1–6 and Comparative Examples 1–5, respectively) was contained in a cyan toner developing device 43 of an image forming apparatus as shown in FIG. 1 and then was subjected to image formation on 10000 sheets (or 15000 sheets for image unevenness evaluation in Example 10).

The results are shown in Table 4 below.

The cyan toner developing device 43 included a developing sleeve 99, a (toner) application roller 102 and a (toner) application blade 103 as shown in FIG. 3.

In these Examples and Comparative Examples, an electrostatic image was developed in a reversal developing system according to a non-magnetic monocomponent developing method.

Further, respective evaluations were performed as follows.

Transfer Efficiency

The transfer efficiency (%) was determined according to the following equation:

Transfer efficiency (%)=(toner amount on paper/toner amount before transfer onto photosensitive member)×100.

Image unevenness

The image unevenness was evaluated by eye observation whether streak image defects or wavy image defects occur at the time of prescribed sheets of image formation.

For instance, in Table 4, ">10000" means that the image defects were not observed up to 10000 sheets of image formation and "<2500" means that the image defects were observed up to 2500 sheets of image formation. Further, "at ca. 9500" means that the image defects were observed on ca. 9500-th sheet.

Image density

The image density was measured by a Macbeth densitometer (mfd. by Macbeth Co.) with respect to a square solid image (5 mm×5 mm).

Triboelectric charge on developing sleeve ($TC_{sleeve}$)

The triboelectric charge of the toner on the developing sleeve (mC/kg) was measured according to a so-called blow-off method in an environment of 23° C. and 60% RH.

TABLE 4

| Ex. No. | Toner | Transfer efficiency (%) Initial | Transfer efficiency (%) After $10^4$ sheets | Image unevenness Streak | Image unevenness Wavy | Image density Initial | Image density After $10^4$ sheets | TC sleeve (mC/kg) Initial | TC sleeve (mC/kg) After $10^4$ sheets |
|---|---|---|---|---|---|---|---|---|---|
| Ex. | Cyan toner No. | | | | | | | | |
| 7 | 1 | 96 | 95 | >10000 | >10000 | 1.52 | 1.51 | −30 | −30 |
| 8 | 2 | 94 | 92 | at ca. 9500 | >9500 | 1.50 | 1.48 | −32 | −30 |
| 9 | 3 | 94 | 90 | at ca. 9000 | >9000 | 1.50 | 1.42 | −31 | −28 |
| 10 | 4 | 97 | 96 | >15000 | >15000 | 1.53 | 1.52 | −31 | −31 |
| 11 | 5 | 94 | 90 | >8500 | at ca. 8000 | 1.51 | 1.41 | −32 | −35 |
| 12 | 6 | 95 | 90 | at ca. 8000 | >8500 | 1.52 | 1.40 | −29 | −26 |
| Comp. Ex. | Comp. cyan toner No. | | | | | | | | |
| 6 | 1 | 94 | 85 | <2500 | >2500 | 1.48 | 1.45 | −28 | −15 |
| 7 | 2 | 96 | 83 | >2000 | <2000 | 1.49 | 1.25 | −30 | −40 |
| 8 | 3 | 90 | 85 | <5000 | <5000 | 1.47 | 1.44 | −31 | −20 |
| 9 | 4 | 92 | 88 | <6000 | <5000 | 1.48 | 1.43 | −33 | −25 |
| 10 | 5 | 90 | 84 | <7000 | >7000 | 1.48 | 1.47 | −32 | −26 |

What is claimed is:

1. A toner for developing an electrostatic image, comprising: toner particles and an additive, wherein said toner particles have a shape factor SF-1 of 100–160, a phase factor SF-2 of 100–140 and a weight-average particle size of 4–10 μm as measured by a Coulter counter, and said toner contains particles having circle-equivalent diameters in a range of 0.6–2.0 μm and satisfying the following conditions (i)–(iii):

(i) a first value $C_1$ of 3–50% by number as measured by a flow particle image analyzer after application of a ultrasonic wave of 20 kHz for 5 min., (ii) a second value $C_2$ of 2–40% by number as measured by the flow particle image analyzer after application of a ultrasonic wave of 20 kHz for 1 min., and (iii) a value C of 105–150 obtained according to the following equation:

$$C=(C_1/C_2)\times 100.$$

2. The toner according to claim 1, wherein the first value $C_1$ is 3–45% by number.

3. The toner according to claim 1, wherein the first value $C_1$ is 3–40% by number.

4. The toner according to claim 1, wherein the first value $C_1$ is 5–40% by number, the second value $C_2$ is 3–35% by number, and the value C is 110–145.

5. The toner according to claim 4, wherein the value C is 110–140.

6. The toner according to claim 1, wherein the first value $C_1$ is 10–35% by number, the second value $C_2$ is 8–25% by number, and the value C is 115–140.

7. The toner according to claim 1, wherein said toner particles have a shape factor SF-1 of 100–150 and a shape factor SF-2 of 100–130.

8. The toner according to claim 1, wherein said toner particles have a shape factor SF-1 of 100–130 and a shape factor SF-2 of 100–125.

9. The toner according to claim 1, wherein said toner particles comprise non-magnetic toner particles.

10. The toner according to claim 9, wherein said non-magnetic toner particles comprises at least a binder resin and a colorant.

11. The toner according to claim 9, wherein said non-magnetic toner particles comprises at least a binder resin, a colorant and a low-softening point substance.

12. The toner according to claim 9, wherein said non-magnetic toner particles comprise at least a binder resin, a colorant, a low-softening point substance and a charge control agent.

13. The toner according to claim 1, wherein said additive comprises silica fine powder.

14. The toner according to claim 1, wherein said additive comprises hydrophobic silica fine powder.

15. The toner according to claim 1, wherein said additive comprises silica fine powder having a BET specific surface area of 20–400 $m^2/g$.

16. The toner according to claim 1, wherein said additive comprises hydrophobic silica fine powder having a BET specific surface area of 2–400 $m^2/g$.

17. The toner according to claim 1, wherein said additive comprises inorganic oxide particles having an average particle size of 0.1–3.0 μm.

18. The toner according to claim 1, wherein said additive comprises inorganic double oxide particles having an average particle size of 0.1–3.0 μm.

19. The toner according to claim 1, wherein said additive comprises strontium titanate particles having an average particle size of 0.1–3.0 μm.

20. The toner according to claim 1, wherein said additive comprises calcium titanate particles having an average particle size of 0.1–3.0 μm.

21. The toner according to claim 1, wherein said additive comprises hydrophobic silica fine powder and strontium titanate particles.

22. The toner according to claim 1, wherein said toner provides a difference between a first value $C_1$ and a second value $C_2$, said difference being resulting from an amount of free resin particles detached from said toner particles.

23. The toner according to claim 1, wherein said toner particles comprise toner particles produced by forming a polymerizable monomer composition comprising at least a polymerizable monomer, a colorant and a polymerization initiator into particles and by polymerizing the polymerizable monomer in the particles of the polymerizable monomer composition.

24. The toner according to claim 23, wherein said toner particles comprise non-magnetic toner particles produced according to suspension polymerization.

25. The toner according to claim 1, wherein said toner particles comprise non-magnetic toner particles which have a shape factor SF-1 of 100–130, a shape factor SF-2 of 100–125, a first value $C_1$ of 10–35% by number, a second value $C_2$ of 8–25% by number and a value C of 115–140.

26. The toner according to claim 25, wherein said toner particles show an increase in % by number from the second value $C_2$ to the first value $C_1$, said increase being resulting from a degree of detachment of fine resin particles attached to surfaces of said toner particles from the surfaces of said toner particles.

27. The toner according to claim 26, wherein said toner particles comprise a binder resin and a non-magnetic colorant and the detached fine resin particles are formed of a resin similar to a resin for the binder resins.

28. The toner according to claim 27, wherein the binder resin of said toner particles comprises a styrene-acrylate copolymer and the detached fine resin particles comprise a styrene-acrylate copolymer.

29. An image forming method, comprising the steps of:

charging an electrostatic image-bearing member, exposing the charged electrostatic image-bearing member to light to form an electrostatic image, developing the electrostatic image by means of a developing apparatus unit including at least a toner-carrying member, toner application means for applying a toner onto a surface of the toner-carrying member and a toner vessel holding said toner to form a toner image on the electrostatic image-bearing member, transferring the toner image onto a transfer-receiving material via or not via an intermediate transfer member, and fixing the toner image on the transfer-receiving material by hot-pressure fixing means, wherein said toner comprises toner particles and an additive, said toner particles have a shape factor SF-1 of 100–160, a phase factor SF-2 of 100–140 and a weight-average particle size of 4–10 $\mu$m as measured by a Coulter counter, and said toner contains particles having circle-equivalent diameters in a range of 0.6–2.0 $\mu$m and satisfying the following conditions (i)–(iii):

(i) a first value $C_1$ of 3–50% by number as measured by a flow particle image analyzer after application of a ultrasonic wave of 20 kHz for 5 min., (ii) a second value $C_2$ of 2–40% by number as measured by the flow particle image analyzer after application of a ultrasonic wave of 20 kHz for 1 min., and (iii) a value C of 105–150 obtained according to the following equation:

$$C=(C_1/C_2)\times 100.$$

30. The image forming method according to claim 29, wherein said toner comprises a non-magnetic toner and the electrostatic image is developed according to a non-magnetic monocomponent developing method.

31. The image forming method according to claim 30, wherein the electrostatic image is developed according to a reversal developing method.

32. The image forming method according to claim 30, wherein said non-magnetic toner is applied onto the surface of the toner-carrying member by toner application means including an elastic blade.

33. The image forming method according to claim 30, wherein said non-magnetic toner is applied onto the surface of the toner-carrying member by toner application means including an application roller.

34. The image forming method according to claim 29, wherein the first value $C_1$ is 3–45% by number.

35. The image forming method according to claim 29, wherein the first value $C_1$ is 3–40% by number.

36. The image forming method according to claim 29, wherein the first value $C_1$ is 5–40% by number, the second value $C_2$ is 3–35% by number, and the value C is 110–145.

37. The image forming method according to claim 36, wherein the value C is 110–140.

38. The image forming method according to claim 29, wherein the first value $C_1$ is 10–35% by number, the second value $C_2$ is 8–25% by number, and the value C is 115–140.

39. The image forming method according to claim 29, wherein said toner particles have a shape factor SF-1 of 100–150 and a shape factor SF-2 of 100–130.

40. The image forming method according to claim 29, wherein said toner particles have a shape factor SF-1 of 100–130 and a shape factor SF-2 of 100–125.

41. The image forming method according to claim 29, wherein said toner particles comprise non-magnetic toner particles.

42. The image forming method according to claim 41, wherein said non-magnetic toner particles comprises at least a binder resin and a colorant.

43. The image forming method according to claim 41, wherein said non-magnetic toner particles comprises at least a binder resin, a colorant and a low-softening point substance.

44. The image forming method according to claim 41, wherein said non-magnetic toner particles comprise at least a binder resin, a colorant, a low-softening point substance and a charge control agent.

45. The image forming method according to claim 29, wherein said additive comprises silica fine powder.

46. The image forming method according to claim 29, wherein said additive comprises hydrophobic silica fine powder.

47. The image forming method according to claim 29, wherein said additive comprises silica fine powder having a BET specific surface area of 20–400 $m^2/g$.

48. The image forming method according to claim 29, wherein said additive comprises hydrophobic silica fine powder having a BET specific surface area of 2–400 $m^2/g$.

49. The image forming method according to claim 29, wherein said additive comprises inorganic oxide particles having an average particle size of 0.1–3.0 $\mu$m.

50. The image forming method according to claim 29, wherein said additive comprises inorganic double oxide particles having an average particle size of 0.1–3.0 $\mu$m.

51. The image forming method according to claim 29, wherein said additive comprises strontium titanate particles having an average particle size of 0.1–3.0 $\mu$m.

52. The image forming method according to claim 29, wherein said additive comprises calcium titanate particles having an average particle size of 0.1–3.0 $\mu$m.

53. The image forming method according to claim 29, wherein said additive comprises hydrophobic silica fine powder and strontium titanate particles.

54. The image forming method according to claim 29, wherein said toner provides a difference between a first value $C_1$ and a second value $C_2$, said difference being resulting from an amount of free resin particles detached from said toner particles.

55. The image forming method according to claim 29, wherein said toner particles comprise toner particles produced by forming a polymerizable monomer composition comprising at least a polymerizable monomer, a colorant and a polymerization initiator into particles and by polymerizing the polymerizable monomer in the particles of the polymerizable monomer composition.

56. The image forming method according to claim 55, wherein said toner particles comprise non-magnetic toner particles produced according to suspension polymerization.

57. The image forming method according to claim 29, wherein said toner particles comprise non-magnetic toner particles which have a shape factor SF-1 of 100–130, a shape factor SF-2 of 100–125, a first value $C_1$ of 10–35% by number, a second value $C_2$ of 8–25% by number and a value C of 115–140.

58. The image forming method according to claim 57, wherein said toner particles show an increase in % by number from the second value $C_2$ to the first value $C_1$, said increase being resulting from a degree of detachment of fine resin particles attached to surfaces of said toner particles from the surfaces of said toner particles.

59. The image forming method according to claim 58, wherein said toner particles comprise a binder resin and a non-magnetic colorant and the detached fine resin particles are formed of a resin similar to a resin for the binder resins.

60. The image forming method according to claim 59, wherein the binder resin of said toner particles comprises a styrene-acrylate copolymer and the detached fine resin particles comprise a styrene-acrylate copolymer.

61. A developing apparatus unit detachably mountable to a main body of an image forming apparatus main body, comprising:

at least a toner-carrying member, toner application means for applying a toner onto a surface of the toner-carrying member, and a toner vessel holding said toner, wherein said toner comprises toner particles and an additive, said toner particles have a shape factor SF-1 of 100–160, a phase factor SF-2 of 100–140 and a weight-average particle size of 4–10 $\mu$m as measured by a Coulter counter, and said toner contains particles having circle-equivalent diameters in a range of 0.6–2.0 $\mu$m and satisfying the following conditions (i)–(iii):

(i) a first value $C_1$ of 3–50% by number as measured by a flow particle image analyzer after application of a ultrasonic wave of 20 kHz for 5 min., (ii) a second value $C_2$ of 2–40% by number as measured by the flow particle image analyzer after application of a ultrasonic wave of 20 kHz for 1 min., and (iii) a value C of 105–150 obtained according to the following equation:

$$C=(C_1/C_2)\times 100.$$

62. The developing apparatus unit according to claim 61, wherein said toner comprises a non-magnetic toner and said toner application means comprises an elastic blade.

63. The developing apparatus unit according to claim 61, wherein said toner comprises a non-magnetic toner and said toner application means comprises a toner application roller.

64. The developing apparatus unit according to claim 61, wherein the first value $C_1$ is 3–45% by number.

65. The developing apparatus unit according to claim 61, wherein the first value $C_1$ is 3–40% by number.

66. The developing apparatus unit according to claim 61, wherein the first value $C_1$ is 5–40% by number, the second value $C_2$ is 3–35% by number, and the value C is 110–145.

67. The developing apparatus unit according to claim 66, wherein the value C is 110–140.

68. The developing apparatus unit according to claim 61, wherein the first value $C_1$ is 10–35% by number, the second value $C_2$ is 8–25% by number, and the value C is 115–140.

69. The developing apparatus unit according to claim 61, wherein said toner particles have a shape factor SF-1 of 100–150 and a shape factor SF-2 of 100–130.

70. The developing apparatus unit according to claim 61, wherein said toner particles have a shape factor SF-1 of 100–130 and a shape factor SF-2 of 100–125.

71. The developing apparatus unit according to claim 61, wherein said toner particles comprise non-magnetic toner particles.

72. The developing apparatus unit according to claim 71, wherein said non-magnetic toner particles comprises at least a binder resin and a colorant.

73. The developing apparatus unit according to claim 71, wherein said non-magnetic toner particles comprises at least a binder resin, a colorant and a low-softening point substance.

74. The developing apparatus unit according to claim 71, wherein said non-magnetic toner particles comprise at least a binder resin, a colorant, a low-softening point substance and a charge control agent.

75. The developing apparatus unit according to claim 61, wherein said additive comprises silica fine powder.

76. The developing apparatus unit according to claim 61, wherein said additive comprises hydrophobic silica fine powder.

77. The developing apparatus unit according to claim 61, wherein said additive comprises silica fine powder having a BET specific surface area of 20–400 $m^2/g$.

78. The developing apparatus unit according to claim 61, wherein said additive comprises hydrophobic silica fine powder having a BET specific surface area of 2–400 $m^2/g$.

79. The developing apparatus unit according to claim 61, wherein said additive comprises inorganic oxide particles having an average particle size of 0.1–3.0 $\mu$m.

80. The developing apparatus unit according to claim 61, wherein said additive comprises inorganic double oxide particles having an average particle size of 0.1–3.0 $\mu$m.

81. The developing apparatus unit according to claim 61, wherein said additive comprises strontium titanate particles having an average particle size of 0.1–3.0 $\mu$m.

82. The developing apparatus unit according to claim 61, wherein said additive comprises calcium titanate particles having an average particle size of 0.1–3.0 $\mu$m.

83. The developing apparatus unit according to claim 61, wherein said additive comprises hydrophobic silica fine powder and strontium titanate particles.

84. The developing apparatus unit according to claim 61, wherein said toner provides a difference between a first value $C_1$ and a second value $C_2$, said difference being resulting from an amount of free resin particles detached from said toner particles.

85. The developing apparatus unit according to claim 61, wherein said toner particles comprise toner particles produced by forming a polymerizable monomer composition comprising at least a polymerizable monomer, a colorant and a polymerization initiator into particles and by polymerizing the polymerizable monomer in the particles of the polymerizable monomer composition.

86. The developing apparatus unit according to claim 85, wherein said toner particles comprise non-magnetic toner particles produced according to suspension polymerization.

87. The developing apparatus unit according to claim 61, wherein said toner particles comprise non-magnetic toner particles which have a shape factor SF-1 of 100–130, a shape factor SF-2 of 100–125, a first value $C_1$ of 10–35% by number, a second value $C_2$ of 8–25% by number and a value C of 115–140.

88. The developing apparatus unit according to claim 87, wherein said toner particles show an increase in % by number from the second value $C_2$ to the first value $C_1$, said increase being resulting from a degree of detachment of fine resin particles attached to surfaces of said toner particles from the surfaces of said toner particles.

89. The developing apparatus unit according to claim 88, wherein said toner particles comprise a binder resin and a non-magnetic colorant and the detached fine resin particles are formed of a resin similar to a resin for the binder resins.

90. The developing apparatus unit according to claim 89, wherein the binder resin of said toner particles comprises a styrene-acrylate copolymer and the detached fine resin particles comprise a styrene-acrylate copolymer.

* * * * *

UNITED STATES PATENT AND TRADEMARK OFFICE

CERTIFICATE OF CORRECTION

PATENT NO. : 5,948,582

DATED : September 7, 1999

INVENTOR(S) : TATSUYA NAKAMURA ET AL.

It is certified that error appears in the above-identified patent and that said Letters Patent is hereby corrected as shown below:

On the title page,
AT [56] OTHER PUBLICATIONS

Insert: "J. Brandup, et al., "The Glass Transition Temperatures of Polymers", Polymer Handbook, 2nd Ed., publ. by Wiley-Interscience (1975), p. III-139 to III-192".

On the title page,
AT [57] ABSTRACT

Line 9, "of a" should read --of an--;
Line 12, "of a" should read --of an--; and
Line 14, "100 The" should read --100. The--.

COLUMN 1

Line 32, "but" should read --but this--;
Line 47, "dispers-" should read --disperse--; and
Line 48, "ing" should be deleted and "(such a" should read --(such--.

COLUMN 2

Line 10, "particles." should read --particle.--;
Line 39, "sable" should read --stable--; and
Line 66, "of a" should read --of an--.

UNITED STATES PATENT AND TRADEMARK OFFICE

CERTIFICATE OF CORRECTION

PATENT NO. : 5,948,582

DATED : September 7, 1999

INVENTOR(S) : TATSUYA NAKAMURA ET AL.

It is certified that error appears in the above-identified patent and that said Letters Patent is hereby corrected as shown below:

COLUMN 3

Line 3, "of a" should read --of an--;
Line 35, "of a" should read --of an--;
Line 39, "of a" should read --of an--;
Line 62, "of a" should read --of an--; and
Line 66, "of a" should read --of an--.

COLUMN 4

Line 53, "of a" should read --of an--; and
Line 57, "a ultrasonic" should read --an ultrasonic--.

COLUMN 5

Line 23, "($C_1$)" should read --($C_1$))--.

COLUMN 10

Line 36, "III," should read --III,"--; and
Line 53, "toner toner" should read --toner--.

UNITED STATES PATENT AND TRADEMARK OFFICE

CERTIFICATE OF CORRECTION

PATENT NO. : 5,948,582

DATED : September 7, 1999

INVENTOR(S) : TATSUYA NAKAMURA ET AL.

It is certified that error appears in the above-identified patent and that said Letters Patent is hereby corrected as shown below:

COLUMN 12

Line 66, "undesirably" should read --an undesirably--; and

Line 67, "a transparency" should read --transparency--.

COLUMN 13

Line 5, "is subjected" should read --are subjected--.

COLUMN 14

Line 24, "an perylene" should read --and perylene--.

COLUMN 15

Line 8, "it is" should read --it is possible to--; and

Line 43, "cellulose sodium salt" should read --cellulose, sodium, salt--.

UNITED STATES PATENT AND TRADEMARK OFFICE

CERTIFICATE OF CORRECTION

PATENT NO. : 5,948,582

DATED : September 7, 1999

INVENTOR(S) : TATSUYA NAKAMURA ET AL.

It is certified that error appears in the above-identified patent and that said Letters Patent is hereby corrected as shown below:

COLUMN 17

Line 36, "from" should read --form--; and
Line 58, "lien" should read --line--.

COLUMN 18

Line 17, "straight(regular)" should read --straight (regular)--.

COLUMN 19

Line 38, "117a." should be BOLDFACE.

COLUMN 20

Line 37, "include" should read --includes--; and
Line 55, "y the" should read --by the--.

COLUMN 21

Line 4, "an medium" should read --a medium--;
Line 13, "(in ia" should read --(in a--;
Line 41, "(magnet color," should read --(magenta color,--; and
Line 42, "a "OFF"" should read --an "Off"--.

UNITED STATES PATENT AND TRADEMARK OFFICE

CERTIFICATE OF CORRECTION

PATENT NO. : 5,948,582

DATED : September 7, 1999

INVENTOR(S) : TATSUYA NAKAMURA ET AL.

It is certified that error appears in the above-identified patent and that said Letters Patent is hereby corrected as shown below:

COLUMN 22

Line 6, "roller" (2nd occurrence) should read --roller 102--;
Line 34, "comprise" should read --comprises--; and
Line 53, "first o fourth" should read --first to fourth--.

COLUMN 23

Line 38, "(magnet color," should read --(magenta color,--;
Line 39, "a "OFF"" should read --an "OFF"--;
Line 40, "color not" should read --color image is not--; and
Line 67, "first o fourth" should read --first to fourth--.

COLUMN 26

Line 29, "(A-2)" should read --(A-1)--; and
Line 36, "step;" should read --step,--.

COLUMN 27

Line 52, "10 hour" should read --10 hours--.

UNITED STATES PATENT AND TRADEMARK OFFICE

CERTIFICATE OF CORRECTION

PATENT NO. : 5,948,582

DATED : September 7, 1999

INVENTOR(S) : TATSUYA NAKAMURA ET AL.

It is certified that error appears in the above-identified patent and that said Letters Patent is hereby corrected as shown below:

COLUMN 31

Line 38, "of a" should read --of an--; and
Line 42, "of a" should read --of an--.

COLUMN 32

Line 28, "comprises" should read --comprise--;
Line 31, "comprises" should read --comprise--;
Line 64, "being" should be deleted; and
Line 65, "detached" should read --being detached--.

COLUMN 33

Line 16, "being" should be deleted;
Line 54, "of a" should read --of an--; and
Line 58, "of a" should read --of an--.

COLUMN 34

Line 32, "comprises" should read --comprise--; and
Line 35, "comprises" should read --comprise--.

COLUMN 35

Line 3, "being" should be deleted;
Line 4, "detached" should read --being detached--; and
Line 24, "being" should be deleted.

UNITED STATES PATENT AND TRADEMARK OFFICE

CERTIFICATE OF CORRECTION

PATENT NO. : 5,948,582

DATED : September 7, 1999

INVENTOR(S) : TATSUYA NAKAMURA ET AL.

It is certified that error appears in the above-identified patent and that said Letters Patent is hereby corrected as shown below:

COLUMN 36

Line 23, "comprises" should read --comprise--;
Line 26, "comprises" should read --comprise--;
Line 61, "being" should be deleted; and
Line 62, "detached" should read --being detached--.

COLUMN 38

Line 2, "being" should be deleted.

Signed and Sealed this

Thirty-first Day of October, 2000

*Attest:*

*Attesting Officer*

Q. TODD DICKINSON

*Director of Patents and Trademarks*